US011533966B2

(12) United States Patent
Capone et al.

(10) Patent No.: US 11,533,966 B2
(45) Date of Patent: Dec. 27, 2022

(54) ARTICLE OF FOOTWEAR WITH REMOVABLE COVER LAYERS AND METHOD OF MANUFACTURING AN ARTICLE OF FOOTWEAR

(71) Applicant: NIKE, Inc., Beaverton, OR (US)

(72) Inventors: Francesca Capone, Portland, OR (US); Arielle Ebenholtz, Beaverton, OR (US); SH Park, Portland, OR (US); Elodie Richez, Portland, OR (US); Tim S. Schulze, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 42 days.

(21) Appl. No.: 17/023,754

(22) Filed: Sep. 17, 2020

(65) Prior Publication Data

US 2021/0186157 A1 Jun. 24, 2021

Related U.S. Application Data

(60) Provisional application No. 62/951,115, filed on Dec. 20, 2019.

(51) Int. Cl.
*A43B 23/02* (2006.01)

(52) U.S. Cl.
CPC ..... *A43B 23/0235* (2013.01); *A43B 23/025* (2013.01); *A43B 23/0255* (2013.01)

(58) Field of Classification Search
CPC ..... A43B 23/0235; A43B 23/025; A43B 23/0255; A43B 23/0295; A43B 23/027; A43B 23/024; A43B 23/0205; A43B 23/026
See application file for complete search history.

(56) References Cited

U.S. PATENT DOCUMENTS

| | | | | |
|---|---|---|---|---|
| 4,726,128 | A | 2/1988 | Lin | |
| 5,073,424 | A | 12/1991 | Dressler | |
| 5,800,900 | A | 9/1998 | Mitchell | |
| 6,092,311 | A | 7/2000 | MacNamara | |
| 6,115,948 | A * | 9/2000 | Mitchell | A41D 27/08 2/245 |
| 9,894,956 | B2 | 2/2018 | Baucom et al. | |

(Continued)

FOREIGN PATENT DOCUMENTS

| | | | |
|---|---|---|---|
| CN | 201328418 | Y | 10/2009 |
| EP | 3092914 | A2 | 11/2016 |

(Continued)

*Primary Examiner* — Jameson D Collier
(74) *Attorney, Agent, or Firm* — Quinn IP Law

(57) ABSTRACT

An article of footwear may include an upper that has a plurality of discrete sections secured to one another. Each discrete section may include a base layer and a cover layer. Each cover layer may be secured to and may cover the outer side of a corresponding base layer. Each cover layer may be configured to be selectively removable from the base layer independently of each other cover layer to expose the outer side of the base layer. A method of manufacturing the article of footwear may include providing the plurality of base layers and providing the plurality of cover layers. The method may further include securing the cover layers to the base layers so that the cover layers cover the outer sides of the base layers.

19 Claims, 19 Drawing Sheets

(56) References Cited

U.S. PATENT DOCUMENTS

| | | | | |
|---|---|---|---|---|
| 2005/0016026 | A1* | 1/2005 | Long | A43B 23/24 36/132 |
| 2006/0101673 | A1* | 5/2006 | Robinson | A43B 23/0235 36/136 |
| 2006/0143951 | A1 | 7/2006 | Yang et al. | |
| 2012/0186107 | A1 | 7/2012 | Crary et al. | |
| 2013/0312286 | A1* | 11/2013 | Fralin | A43B 1/0081 36/101 |
| 2015/0351493 | A1* | 12/2015 | Ashcroft | A43B 5/06 36/132 |
| 2016/0331082 | A1* | 11/2016 | Weidl | A43B 3/26 |
| 2017/0020232 | A1* | 1/2017 | Bello Decurnex | A43B 23/024 |
| 2017/0027273 | A1* | 2/2017 | Colon | A43B 3/242 |
| 2017/0318909 | A1 | 11/2017 | Gilbert | |
| 2018/0264370 | A1 | 9/2018 | Consorti et al. | |
| 2018/0361697 | A1 | 12/2018 | Krichevsky | |
| 2019/0116918 | A1 | 4/2019 | Yeakim | |
| 2021/0177096 | A1* | 6/2021 | Park | A43B 23/0235 |
| 2021/0186158 | A1* | 6/2021 | Capone | A43B 23/0215 |
| 2021/0244131 | A1* | 8/2021 | Capone | A43B 23/0235 |

FOREIGN PATENT DOCUMENTS

| | | | | |
|---|---|---|---|---|
| EP | 3332660 | A1 | 6/2018 | |
| WO | WO-2007096914 | A1 * | 8/2007 | A43B 1/0027 |
| WO | WO-2013048612 | A1 * | 4/2013 | A43B 1/0054 |

* cited by examiner

ARTICLE OF FOOTWEAR WITH REMOVABLE COVER LAYERS AND METHOD OF MANUFACTURING AN ARTICLE OF FOOTWEAR

CROSS-REFERENCE TO RELATED APPLICATIONS

This application is claims priority to, and the benefit of, U.S. Provisional Application No. 62/951,115, filed Dec. 20, 2019, which is hereby incorporated by reference in its entirety.

TECHNICAL FIELD

The present disclosure generally relates to an article of footwear with removable cover layers and a method of manufacturing an article of footwear.

BACKGROUND

Footwear typically includes an upper and a sole structure underlying and secured to the upper. An upper may have a specific material, color, or design for function, for aesthetic appearance, or both. Consumers may select footwear at least in part based on the aesthetic appearance of the footwear.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
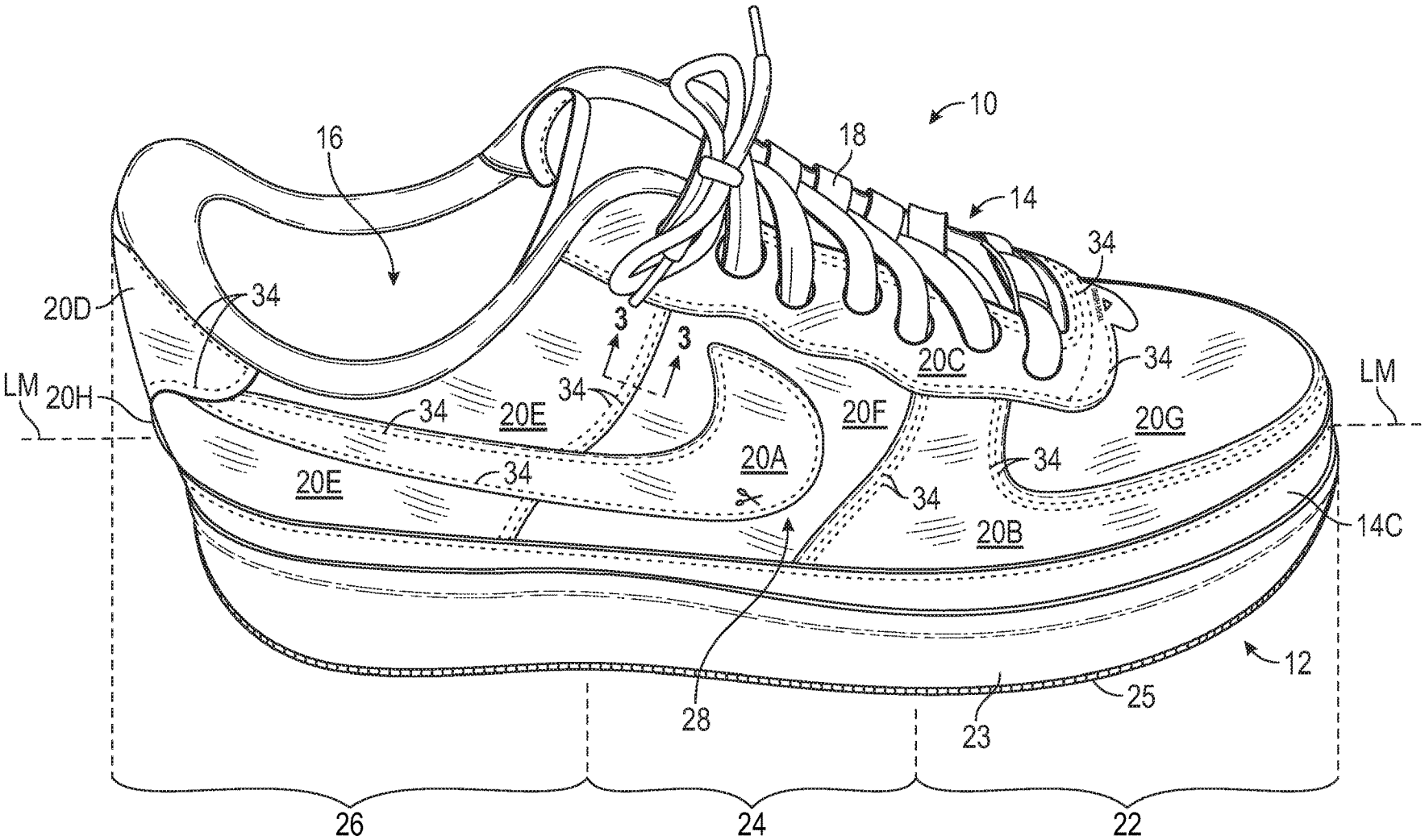
FIG. 1 is a perspective view of a lateral side of an article of footwear.

An article of footwear and a method of manufacturing an article of footwear disclosed herein enable aesthetic and/or functional aspects of a footwear upper to remain a surprise to the wearer until the wearer decides to reveal the aspects. Additionally, the configuration of the upper allows the aspects to be revealed one at a time and in any order.

An article of footwear may include an upper having a plurality of discrete sections secured to one another. Each discrete section may include a base layer and a cover layer. Each cover layer may be secured to and may cover the outer side of a corresponding one of the base layers. Each cover layer may be configured to be selectively removable from the base layer independently of each other cover layer to expose the outer side of the base layer. Stated differently, when a cover layer is removed, each other cover layer may remain secured to and covering the outer side of its corresponding base layer until it is independently selectively removed.

In an aspect, each base layer may have a peripheral edge and the cover layer secured to the base layer may have a portion wrapped around and covering the peripheral edge. For example, the cover layer may include a portion wrapped over the peripheral edge and adhered to an inner side of the base layer. In some embodiments, the cover layers may be opaque. Accordingly, the cover layers may hide the underlying base layers from view, even covering the peripheral edges, until the cover layers are selectively and individually removed. A wearer may choose to keep all of the base layers hidden by the cover layers or may choose to reveal the outer side of any one or more of the base layers by removing the respective cover layer(s).

The cover layers are configured so that selective removal of one or more cover layers may be in any order or combination and may occur at any time during possession of the footwear. The wearer thus may enjoy many different and surprising appearances from a single article of footwear. Additionally, the outer side of at least one of the base layers may comprise a different material or may have a different color, texture, or pattern than at least one other of the base layers. At least one of the cover layers may be entirely on a lateral side of the upper. Additionally, at least one of the cover layers may be entirely on a medial side of the upper. Accordingly, a different material, color, texture, or pattern of an underlying base layer may be present only at the lateral side or only at the medial side of the upper in some embodiments.

In another aspect, each cover layer may be secured to its corresponding base layer by stitches extending through the cover layer and the base layer. Each of the base layers may be bordered by at least two other of the base layers. The stitches may extend through a pair of bordering base layers and the respective cover layers may cover the base layers.

In an aspect, at least one of the cover layers may define an integral pull tab disposed at an edge of the corresponding base layer to which the cover layer is secured. For example, the cover layer defining the integral pull tab may be disposed on a throat portion of the upper with the integral pull tab extending forward over a toe region of the upper. In this position, the pull tab is relatively protected so that scuffs and bumps against the footwear will not unintentionally pull on the pull tab. One or more different cover layers may include an integral pull tab instead of or in addition to the cover layer located on the throat portion. For example, cover layers at either or both of the medial and lateral side portions may include integral pull tabs.

The base layer and the cover layers may be a variety of different materials. For example, one or more of the base layers may be leather or a synthetic leather. One or more of the cover layers may be a nonwoven textile.

A method of manufacturing an article of footwear such as the article of footwear disclosed herein may include providing a plurality of base layers of an upper and providing a plurality of cover layers. The method may further include securing the cover layers to the base layers, each cover layer secured to a different corresponding one of the base layers so that the cover layer covers an outer side of the base layer. After securing the cover layers to the base layers, the method may then include securing the base layers to one another to define a foot-receiving cavity with each cover layer selectively removable from the corresponding base layer independently of each other cover layer to expose the outer side of the base layer with each other cover layer remaining secured to and covering the outer side of its corresponding base layer until independently selectively removed.

In an aspect, securing the cover layers to the base layers may include wrapping the cover layers around peripheral edges of the base layers and securing the cover layers to inner sides of the base layers. Securing the cover layers to inner sides of the base layers may include adhering the cover layers to the inner sides of the base layers. Furthermore, securing the base layers to one another may include stitching adjacent ones of the base layers to one another with a series of stitches, the series of stitches extending through the adjacent ones of the base layers and through the cover layers secured to the adjacent ones of the base layers.

In one example, at least one of the cover layers may include a pull tab. The method may include, prior to securing the cover layers to the base layers, disposing the pull tab at a peripheral edge of the corresponding base layer to which the at least one of the cover layers is to be secured.

The method enables different articles of footwear manufactured in the same manner to have the same initial look (e.g., when the base layers are covered by the cover layers) but different appearances once one or more of the base layers are revealed by removal of the corresponding cover layers. More specifically, the base layer and the cover layers discussed above may be of a first upper of a first article of footwear, and the method further comprising manufacturing a second article of footwear by providing a second plurality of base layers of a second upper. The second plurality of base layers may correspond in shape and dimension to the plurality of base layers of the first article of footwear. However, at least one of the second plurality of base layers may comprise a different material or may have a different color, texture, or pattern than a corresponding one the base layers of the first article of footwear. The method may further comprise providing a second plurality of cover layers and securing the second plurality of cover layers to the second plurality of base layers. Each cover layer of the second plurality of cover layers may be secured to and may cover an outer side of a different corresponding one of the base layers of the second plurality of base layers. After securing the second plurality of cover layers to the second plurality of base layers, the method may include securing the second plurality of base layers to one another with each cover layer of the second plurality of cover layers selectively removable from the different corresponding one of the second plurality of base layers independently of each other cover layer of the second plurality of cover layers to expose the outer side of the base layer with each other cover layer of the second plurality of cover layers remaining secured to and covering the corresponding one of the base layers of the second plurality of base layers until independently selectively removed. Because at least one of the second plurality of base layers may comprise a different material or may have a different color, texture, or pattern than a corresponding one the base layers of the first article of footwear, the second article of footwear will have a different appearance than the first article of footwear when the cover layer of that base layer is removed.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 is a lateral side view of an article of footwear 10 that has a sole structure 12 and an upper 14 secured to the sole structure 12. The upper 14 forms a foot-receiving cavity 16 configured to receive a foot. The upper 14 may be a variety of materials, such as leather, textiles, polymers, cotton, foam, composites, etc., and is shown with a lace 18 for tightening the upper 14 around a foot (not shown). As discussed further herein, the upper 14 is configured to have many different appearances than that shown in FIG. 1, any one of which results from the optional selective removal of one or more discrete cover layers 20A-20K described herein.

The footwear 10 illustrated herein is depicted as an athletic shoe configured for sports or for wear as a leisure shoe, but the footwear 10 is not limited to athletic or leisure shoes. The footwear 10, including its components described herein, may be an athletic shoe, a leisure shoe, a dress shoe, a work shoe, a sandal, a slipper, a boot, or any other category of footwear. As indicated in FIG. 1, the footwear 10 may be divided into a forefoot region 22, a midfoot region 24, and a heel region 26, which are also the forefoot region, the midfoot region, and the heel region, respectively, of the sole structure 12 and the upper 14. The forefoot region 22 generally includes portions of the article of footwear 10 corresponding with the toes and the joints connecting the metatarsals with the phalanges. The midfoot region 24 generally includes portions of the article of footwear 10 corresponding with the arch area and instep of the foot, and the heel region 26 corresponds with rear portions of the foot, including the calcaneus bone. The forefoot region 22, the midfoot region 24, and the heel region 26 are not intended to demarcate precise areas of the footwear 10 but are instead intended to represent general areas of the footwear 10 to aid in the following discussion.

The sole structure 12 includes a midsole 23 and an outsole 25 which are integrated as a unitary component in the embodiment shown and may be referred to as a unisole. An insole (not shown) may rest on the sole structure 12 in the foot-receiving cavity 16. The midsole 23 attenuates ground reaction forces (e.g., provides cushioning) when compressed between the foot and the ground during walking, running, or other ambulatory activities. The outsole 25 establishes the ground-engaging surface of the article of footwear 10 and may be one-piece or may be several discrete outsole components. In one example, the outsole 25 may be formed from a wear-resistant material that may be textured to impart traction. For example, the outsole 25 may comprise a natural or synthetic rubber.

When the foot is positioned within the foot-receiving cavity 16 of the footwear 10, it is supported on a foot-facing surface of the midsole 23. The foot-facing surface of the midsole 23 may be covered by a strobel (not shown) secured to a lower region 14C of the upper 14. Also, an insole (not shown) may rest on the strobel or directly on the sole structure 12 in embodiments without a strobel, in which case the foot is supported by both the sole structure 12 and the insole.

Figure 2:
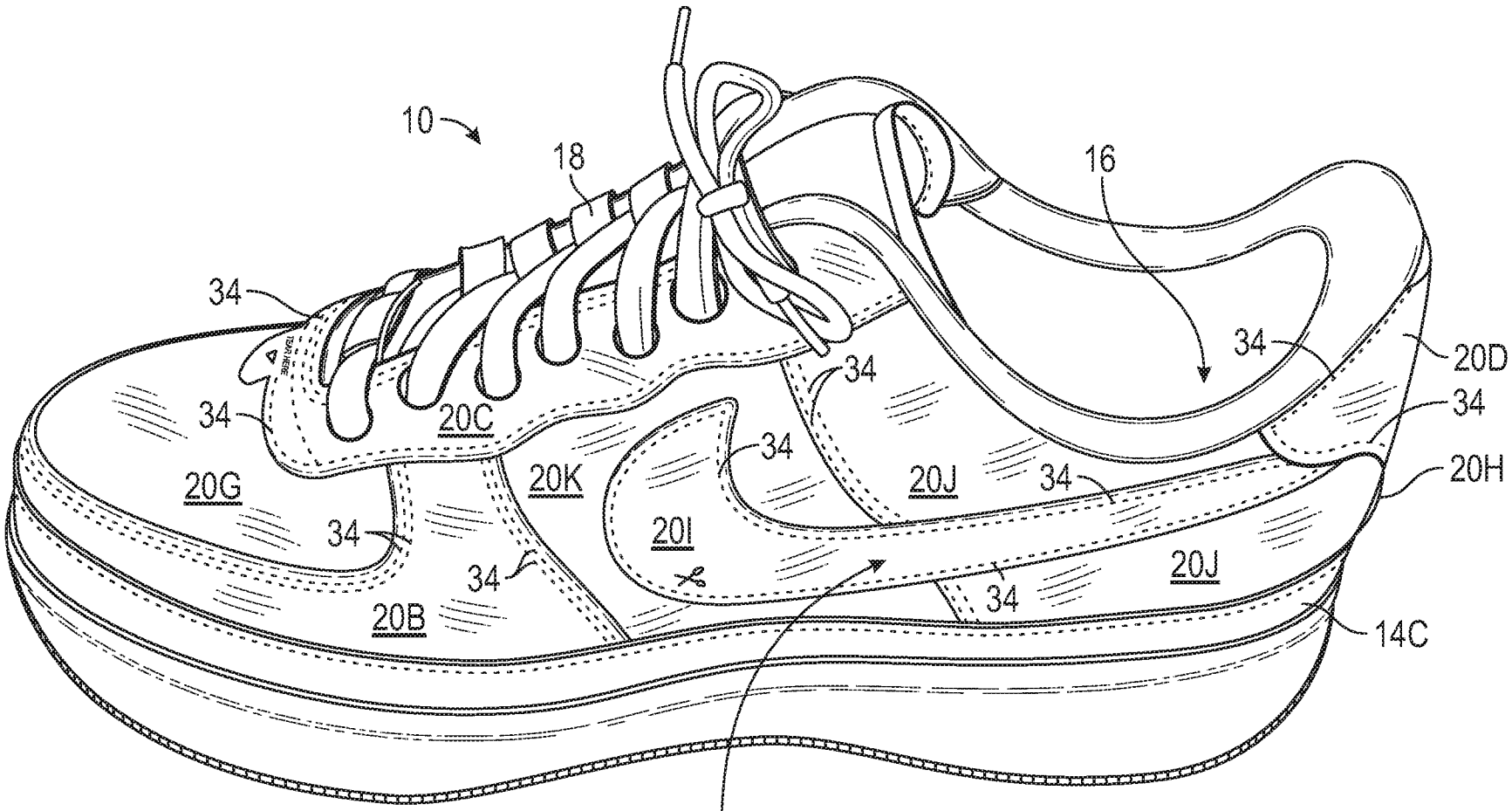
FIG. 2 is a perspective view of a medial side of the article of footwear of FIG. 1.

The footwear 10 has a lateral side 28 (shown in FIG. 1) and a medial side 30 (best shown in FIG. 2). The lateral side 28 and the medial side 30 extend through each of the forefoot region 22, the midfoot region 24, and the heel region 26, each falling on an opposite side of a longitudinal midline LM of the article of footwear 10, as is understood by those skilled in the art. The medial side 30 is thus considered opposite to the lateral side 28.

Figure 3:
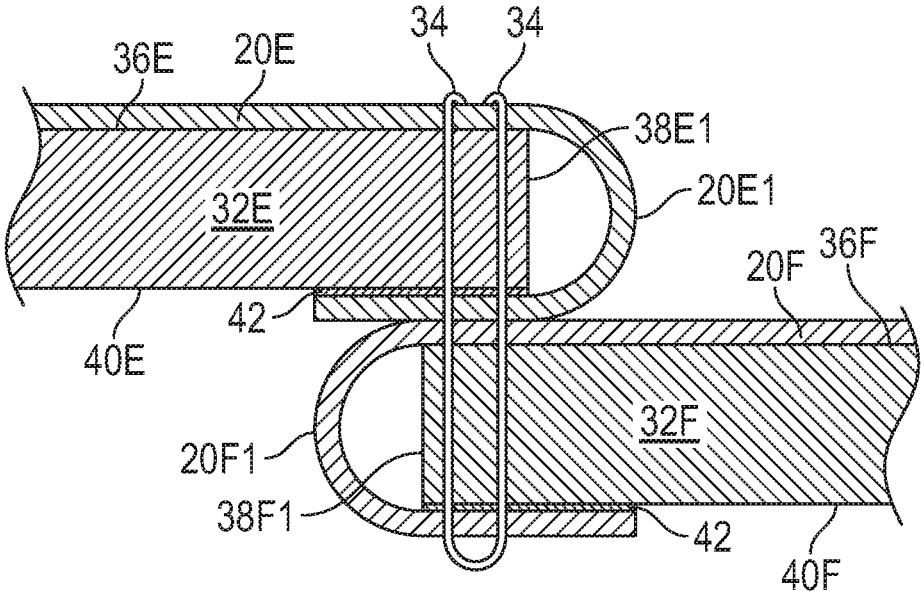
FIG. 3 is a fragmentary cross-sectional view taken at lines 3-3 in FIG. 1.

The upper 14 includes a plurality of base layers 32A-32K secured to one another. The base layers 32A-32K are individually revealed in FIGS. 5-16 as the respective cover layers 20A-20K are selectively and individually removed. Each base layer 32A-32K has a respective outer side 36A-36K that is viewable from the exterior of the article of footwear 10 when the respective cover layer 20A-20K is removed. In the embodiments shown, adjacent ones of the base layers 32A-32K are secured to one another with stitching 34 as discussed herein. For example, FIG. 3 shows two adjacent base layers 32E and 32F secured to one another with stitching 34. Cover layer 20E covers an outer side 36E of its corresponding base layer 32E. Additionally, a portion 20E1 of the cover layer 20E is wrapped around a peripheral edge 38E1 of the base layer 32E to cover the peripheral edge 38E1 and is secured to an inner side 40E of the base layer 32E with adhesive 42. Similarly, cover layer 20F covers an outer side 36F of its corresponding base layer 32F. Additionally, a portion 20F1 of the cover layer 20F is wrapped around a peripheral edge 38F1 of the base layer 32F to cover the peripheral edge 38F1 and is secured to an inner side 40F of the base layer 32F with adhesive 42. The stitching 34 extends through each of the adjacent base layers 32E, 32F as well as through their respective cover layers 20E, 20F.

Each cover layer 20A-20K corresponds generally in shape and size to the respective base layer 32A-32G to which it is secured so that it can cover the entire outer side of the base layer, wrap around the peripheral edges of the base layer, and secure to the inner side of the respective base layer. The cover layers 20A-20K are secured to the respective base layers 32A-32K only at the stitching 34 indicated in FIGS. 1, 2 and 12. Accordingly, although the cover layers 20A-20K cover the outer sides 36A-36K of the base layers 32A-32K, they are not adhered to the outer sides 36A-36K. The lower region 14C of the upper 14 shown in FIGS. 1 and 2 is not covered by any cover layer and is not considered one of the base layers.

Each cover layer 20A-20K is configured to be selectively removable from the respective base layer 32A-32K independently of each other cover layer to expose the outer side 36A-36K of the base layer. Stated differently, when one cover layer is removed, each other cover layer may remain secured to and covering the outer side of its different corresponding base layer until it is independently selectively removed. The cover layers 20A-20K may be a relatively thin and flexible material, such as a nonwoven textile. Generally, a nonwoven textile or fabric is a sheet or web structure made from fibers and/or yarns that are bonded together. The bond can be a chemical and/or mechanical bond, and can be formed using heat, solvent, adhesive or a combination thereof. Exemplary nonwoven fabrics are flat or tufted porous sheets that are made directly from separate fibers, molten plastic and/or plastic film. They are not made by weaving or knitting and do not necessarily require converting the fibers to yarn, although yarns can be used as a source of the fibers. Nonwoven textiles are typically manufactured by putting small fibers together in the form of a sheet or web (similar to paper on a paper machine), and then binding them either mechanically (as in the case of felt, by interlocking them with serrated or barbed needles, or hydro-entanglement such that the inter-fiber friction results in a stronger fabric), with an adhesive, or thermally (by applying binder (in the form of powder, paste, or polymer melt) and inciting the binder onto the web by increasing temperature). A nonwoven textile can be made from staple fibers (e.g., from wetlaid, airlaid, carding/crosslapping processes), or extruded fibers (e.g., from meltblown or spunbond processes, or a combination thereof), or a combination thereof. Bonding of the fibers in the nonwoven textile can be achieved with thermal bonding (with or without calendering), hydro-entanglement, ultrasonic bonding, needle punching (needle felting), chemical bonding (e.g., using binders such as latex emulsions or solution polymers or binder fibers or powders), meltblown bonding (e.g., fiber is bonded as air attenuated fibers intertangle during simultaneous fiber and web formation). In one example, the cover layers 20A-20K may be made of TYVEK®, a nonwoven textile made of high density polyethylene fibers and available from E.I. du Pont de Nemours and Company of Wilmington, Del. USA. Although the material of the cover layers 20A-20K is not limited to a nonwoven textile, such a material may make each cover layer 20A-20K relatively easy to remove (e.g., cut or tear away) from the base layers 32A-32K to expose the outer sides 36A-36K of the base layers.

In some embodiments, one or more of the cover layers 20A-20K may be opaque so that the color, texture, and material of the corresponding base layer 32A-32K remains hidden until revealed by removal of the cover layer 20A-20K. Accordingly, the footwear 10 could be sold to a consumer without the consumer knowing these characteristics of the base layers 32A-32K. Alternatively, the consumer may know the characteristics of one or more of the base layers 32A-32K when purchasing the footwear 10 such as if the footwear 10 is packaged with a description of the characteristics of the underlying base layer 32A-32K. In either case, the outer sides 36A-36K of the base layers 32A-32K remain hidden from view until the respective cover layers 20A-20K are separately and individually removed, if they are removed at all. Because even the peripheral edges of the base layers 32A-32K are covered by the cover layers 20A-20K, the underlying base layers 32A-32K are totally and completely concealed.

Removal of the cover layers 20A-20K can be in any order and in any combination. FIGS. 5-16 depict just one order and combination of selective removal of the cover layers 20A-20K (e.g., removal of all eleven cover layers 20A-20K in the order indicated from FIG. 5 to FIG. 16). In other possibilities, no cover layers 20A-20K are removed, any one of the cover layers 20A-20K is removed, and two of the cover layers 20A-20K are removed, and three of the cover layers 20A-20K are removed, any four of the cover layers 20A-20K are removed, any five of the cover layers 20A-20K are removed, any six of the cover layers 20A-20K are removed, any seven of the cover layers 20A-20K are removed, any eight of the cover layers 20A-20K are removed, any nine of the cover layers 20A-20K are removed, or any ten of the cover layers 20A-20K are removed.

Accordingly, the footwear 10 may have many different appearances over the course of use depending upon which of the cover layers 20A-20K have been removed and in what order. As further discussed herein, the outer side 36A-36K, respectively, of at least one of the base layers 32A-32K may comprise a different material or may have a different color, texture, and/or pattern than the outer side of at least one other of the base layers. The cover layers 20A-20K may be a variety of different materials. For example, one or more of the base layers 32A-32K may be leather or a synthetic leather. One or more of the cover layers 20A-20K may be a nonwoven textile. The cover layers 20A, 20E, and 20F and their respective underlying base layers 32A, 32E, and 32F are entirely on the lateral side 28 of the upper 14. Cover layers 20I, 20J, and 20K and their respective underlying base layers 32I, 32J, and 32K are entirely on the medial side 30 of the upper 14. Accordingly, once any of these cover layers are removed, the lateral and medial sides may have different appearances as any of the base layers 32A, 32E, and 32F may comprise a different material or may have a different color, texture, and/or pattern than at least one of the base layers 32I, 32J, and 32K.

FIGS. 1 and 2 show that each cover layer 20A-20K is secured to the different corresponding one of the base layers 32A-32K (all of which are covered in FIGS. 1-2 but shown in FIGS. 5-16) by stitches 34 extending through the cover layer and the base layer. Each of the cover layers 20A-20K and the corresponding base layers 32A-32K are bordered by at least two other of the cover layers 20A-20K and corresponding base layers 32A-32K. The stitches 34 extend through a pair of bordering base layers 32A-32K and the respective cover layers 20A-20K covering the pair of bordering base layer 32A-32K. For example, FIG. 1 shows cover layer 20A bordered by cover layers 20D, 20E, and 20F. Cover layer 20B is shown bordered by cover layers 20F, 20C, 20G and 20K (see FIG. 2). Cover layer 20C is bordered by cover layers 20E, 20F, 20B, 20G, 20K, and 20J. Cover layer 20D is bordered by cover layers 20A, 20I, 20E, 20H, and 20J. Cover layer 20E is bordered by cover layers 20D, 20H, 20F, and 20C. Cover layer 20F is bordered by cover layers 20A, 20E, 20B, and 20C. Cover layer 20G is bordered by cover layers 20B and 20C. Cover layer 20H is bordered by cover layers 20D, 20E, and 20J (see FIGS. 1, 2, and 12). Cover layer 20I is bordered by cover layers 20K, 20J, and 20D (see FIG. 2). Cover layer 20J is bordered by cover layers 20C, 20K, 20I, 20D and 20H. Cover layer 20K is bordered by cover layers 20B, 20C, 20I, and 20J. The base layers 32A-32K border one another in the same manner as the corresponding cover layers 20A-20K. Stitches 34 are shown extending through bordering ones of the cover layers 20A-20K and the corresponding bordering ones of the base layers 32A-32K.

Figure 4:
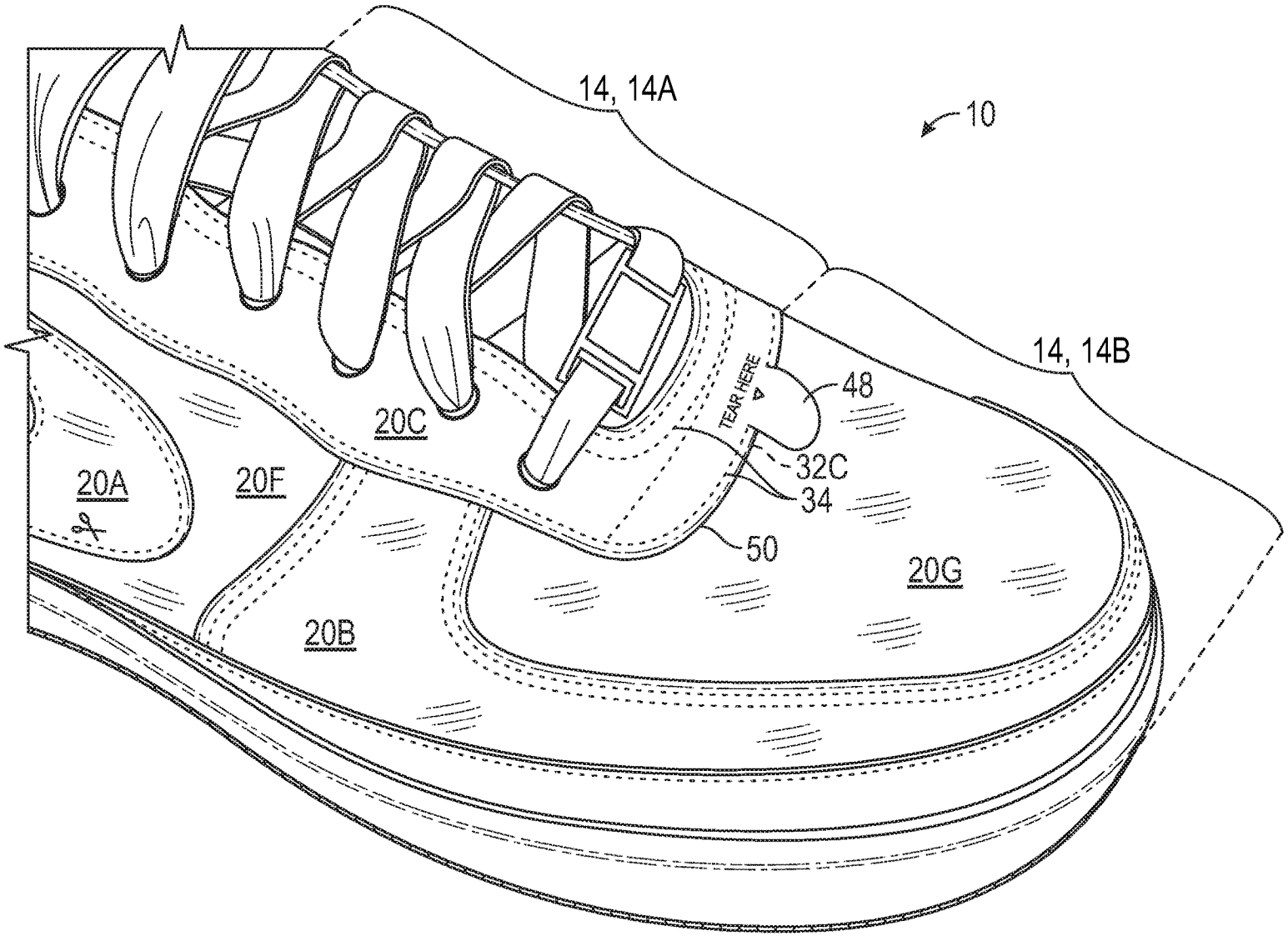
FIG. 4 is a fragmentary perspective view of the article of footwear of FIG. 1.

The cover layers 20A-20K may be selectively individually removed in various different ways. FIG. 4 shows that the cover layer 20C includes an integral pull tab 48 disposed at a peripheral edge 50 of the corresponding base layer 32C to which the cover layer 20C is secured by stitching 34. For example, the cover layer 20C defining the integral pull tab 48 is disposed on a throat portion 14A of the upper 14 with the integral pull tab 48 extending forward over a toe region 14B of the upper 14. In this position, the pull tab 48 is relatively protected so that scuffs and bumps against the footwear 10 will not pull on the pull tab 48 and tear the cover layer 20C. However, if the consumer desires to remove the cover layer 20C, the pull tab 48 may be lifted slightly and pulled straight rearward to tear the cover layer 20C off of the underlying base layer 32C (see FIG. 7). In FIG. 4, the cover layer 20C is marked "TEAR HERE" with an arrowhead indicating the pull tab 48 to direct the user as to how to remove the cover layer 20C. One or more of the other cover layers 20A-20B or 20D-20K may also have an integral pull tab. For example, either or both of the cover layers 20A and 20I at the lateral and medial sides 28, 30 of the footwear 10 may include an integral pull tab like pull tab 48 at a forward edge of the cover layer 20A or 20I, to be pulled rearward to remove the cover layer 20A or 20I.

Instead of removal by pulling a pull tab, one or more of the cover layers 20A-20K may be removed by cutting the cover layer 20A-20K. As shown in FIG. 1, a small scissors icon is printed on the cover layer 20A to indicate that it can be cut with scissors to remove it from the underlying base layer 32A. Cover layer 20I also has a scissors icon (see FIG. 2). The cover layers 20A-20K are secured to the outer sides 36A-36K of the base layers 32A-32K only by the stitching 34 and are secured to the inner sides of the base layers 32A-32K by adhesive 42 (see, e.g., FIG. 3). Because the cover layers 20A-20K are not adhered to the outer sides 36A-36K of the underlying base layers 32A-32K, the cover layers 20A-20K can be removed (such as by tearing or cutting) without affecting the surface of the outer side 36A-36K of the base layers 32A-32K.

Figure 5:
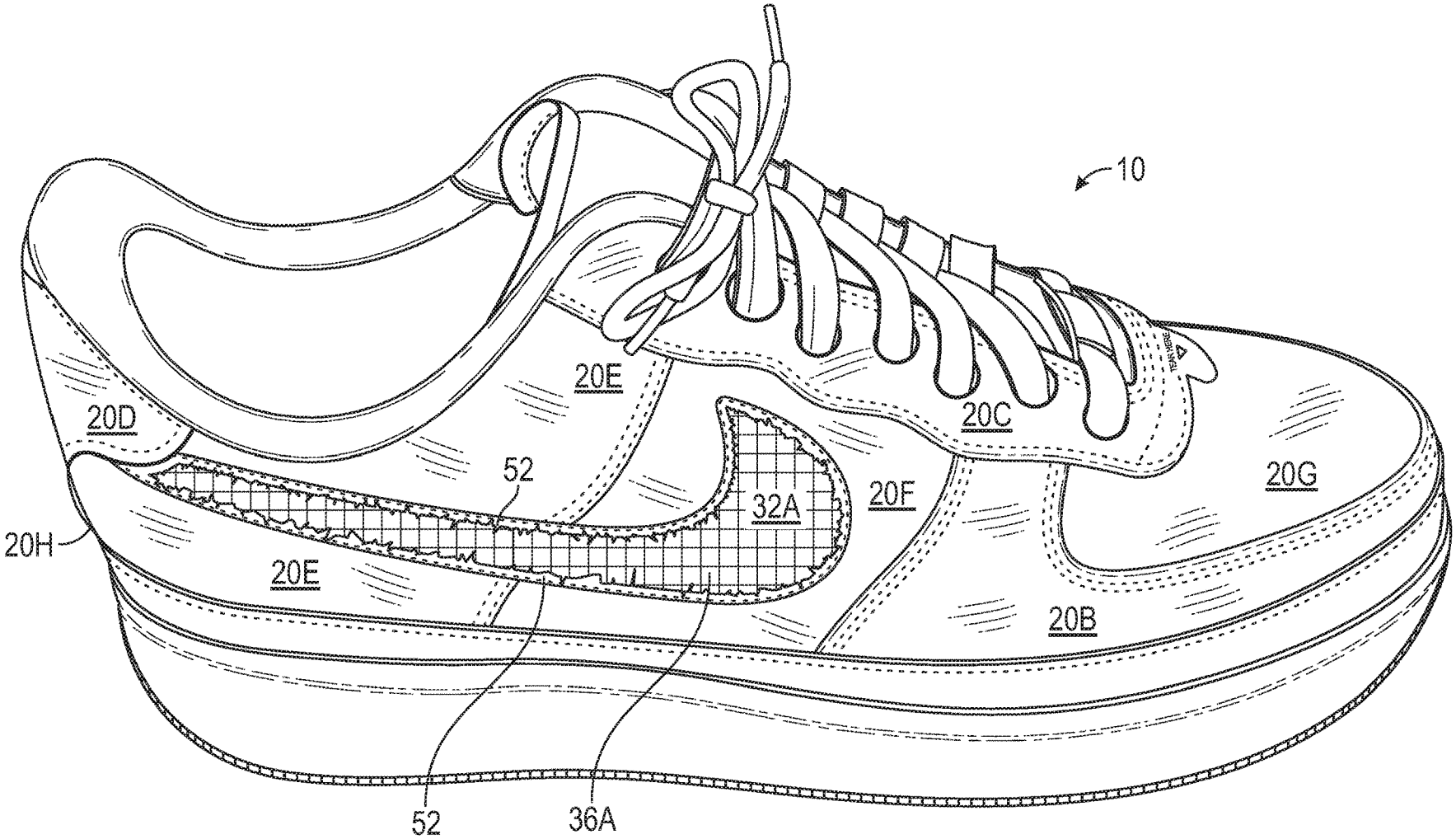
FIG. 5 is a perspective view of the lateral side of the article of footwear of FIG. 1 with a cover layer removed.

FIGS. 5-16 show one example order in which the cover layers 20A-20K can be removed. FIG. 5 shows the footwear 10 with only the cover layer 20A removed to reveal the outer side 36A of the base layer 32A. All other cover layers 20B-20K remain intact covering the respective discreet sections 32B-32K over which they lie and to which they are secured. Due to the securement of the cover layer 20A under the stitching 34, frayed remnants 52 of the cover layer 20A may remain at the stitching 34 when the cover layer 20A is removed. All frayed remnants 52 of various cover layers 20A-20K are indicated in the drawings with reference numeral 52. The remnants 52 provide a unique look, evidencing that the footwear 10 once included an intact cover layer such as cover layer 20A overlying the base layer 32A.

Figure 6:
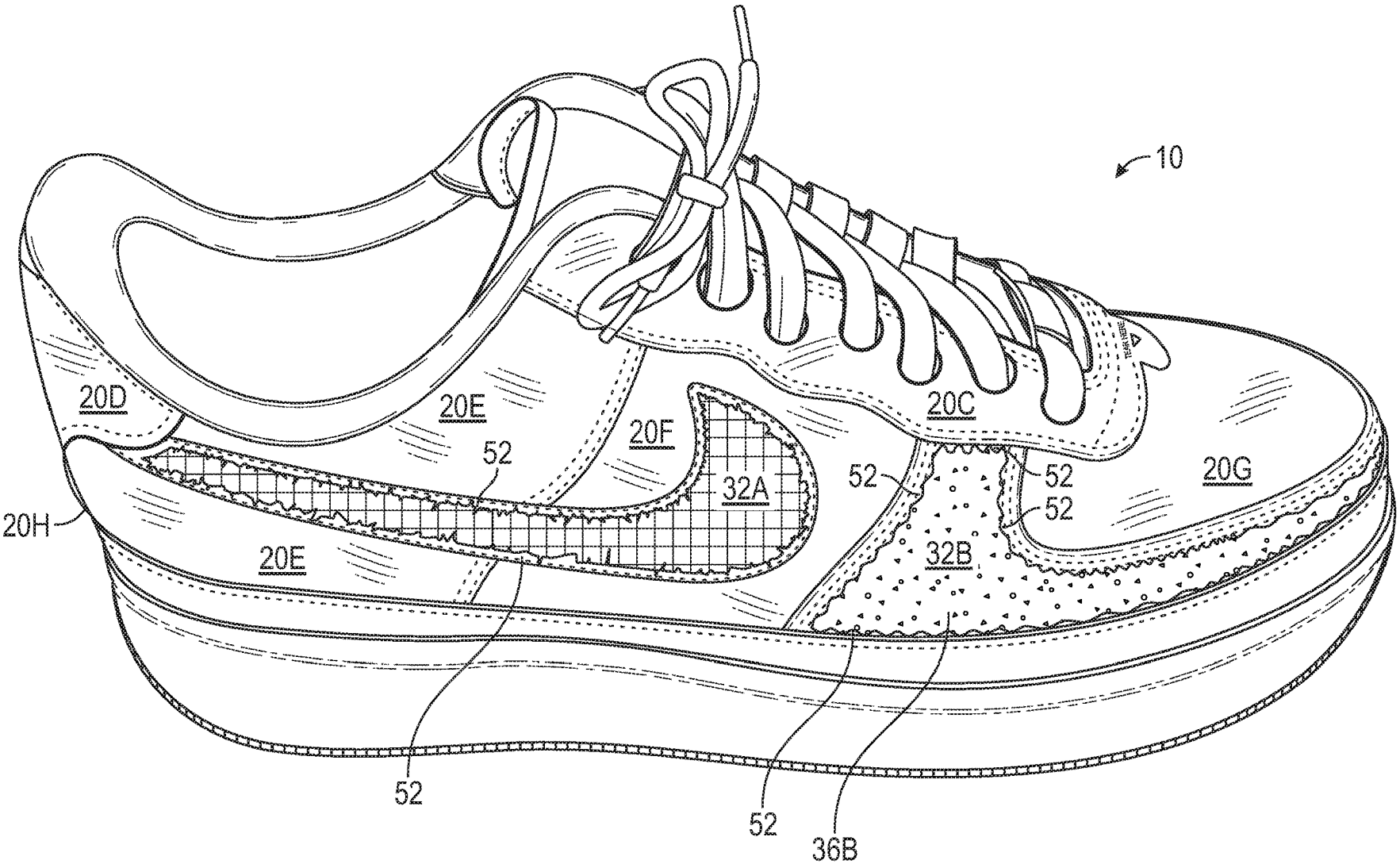
FIG. 6 is a perspective view of the lateral side of the article of footwear of FIG. 1 with two cover layers removed.
Figure 7:
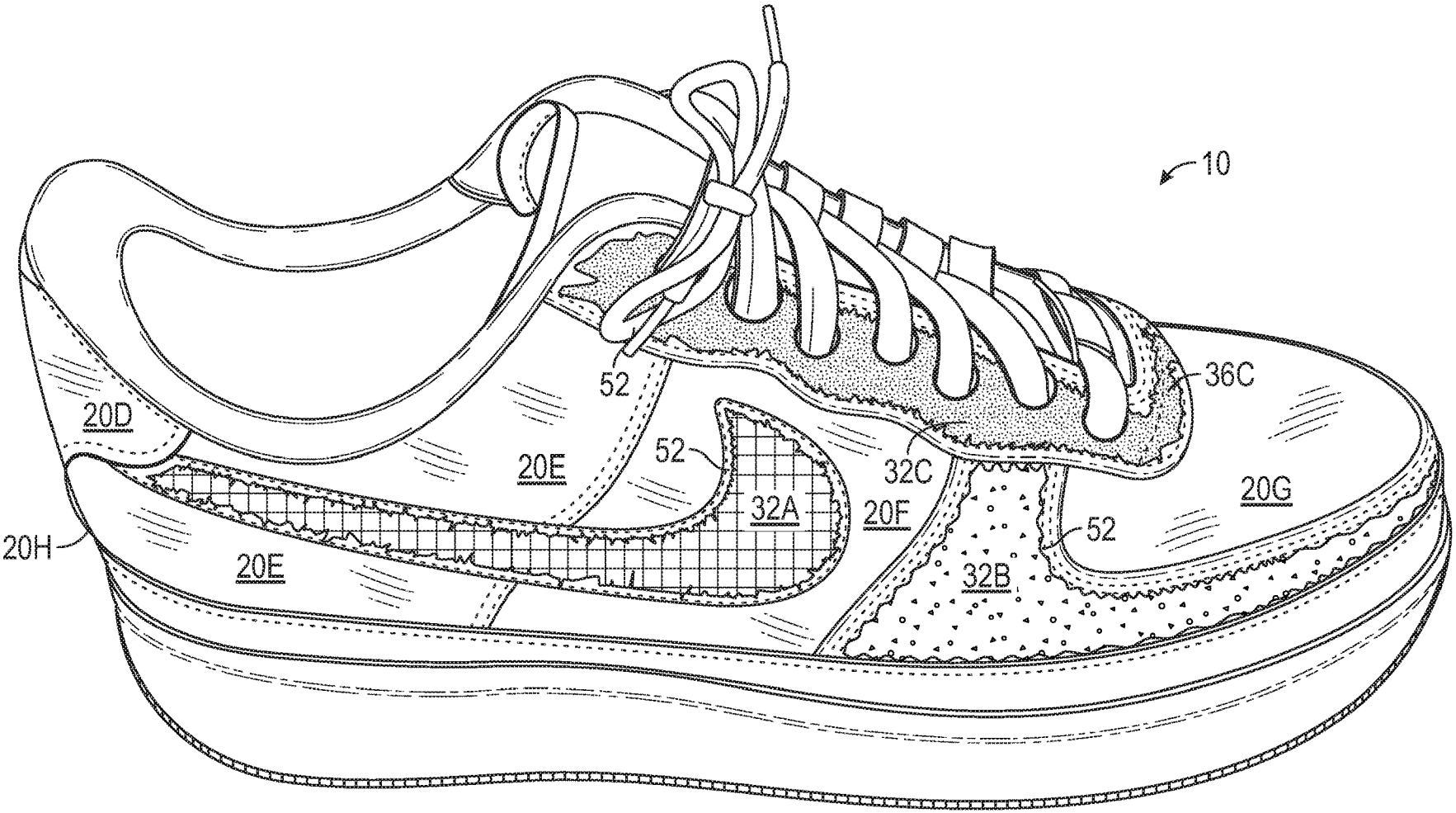
FIG. 7 is a perspective view of the lateral side of the article of footwear of FIG. 1 with three cover layers removed.
Figure 8:
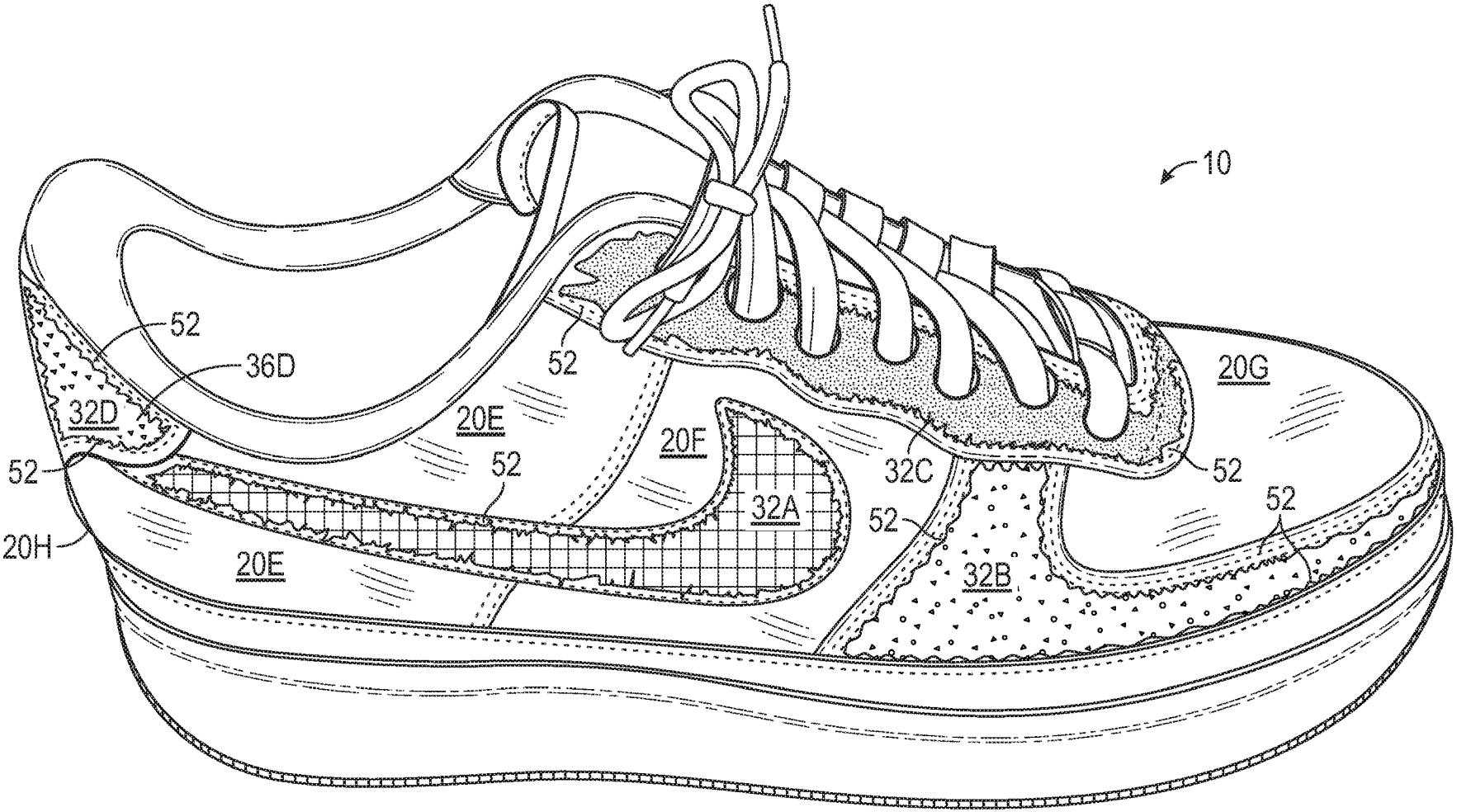
FIG. 8 is a perspective view of the lateral side of the article of footwear of FIG. 1 with four cover layers removed.
Figure 9:
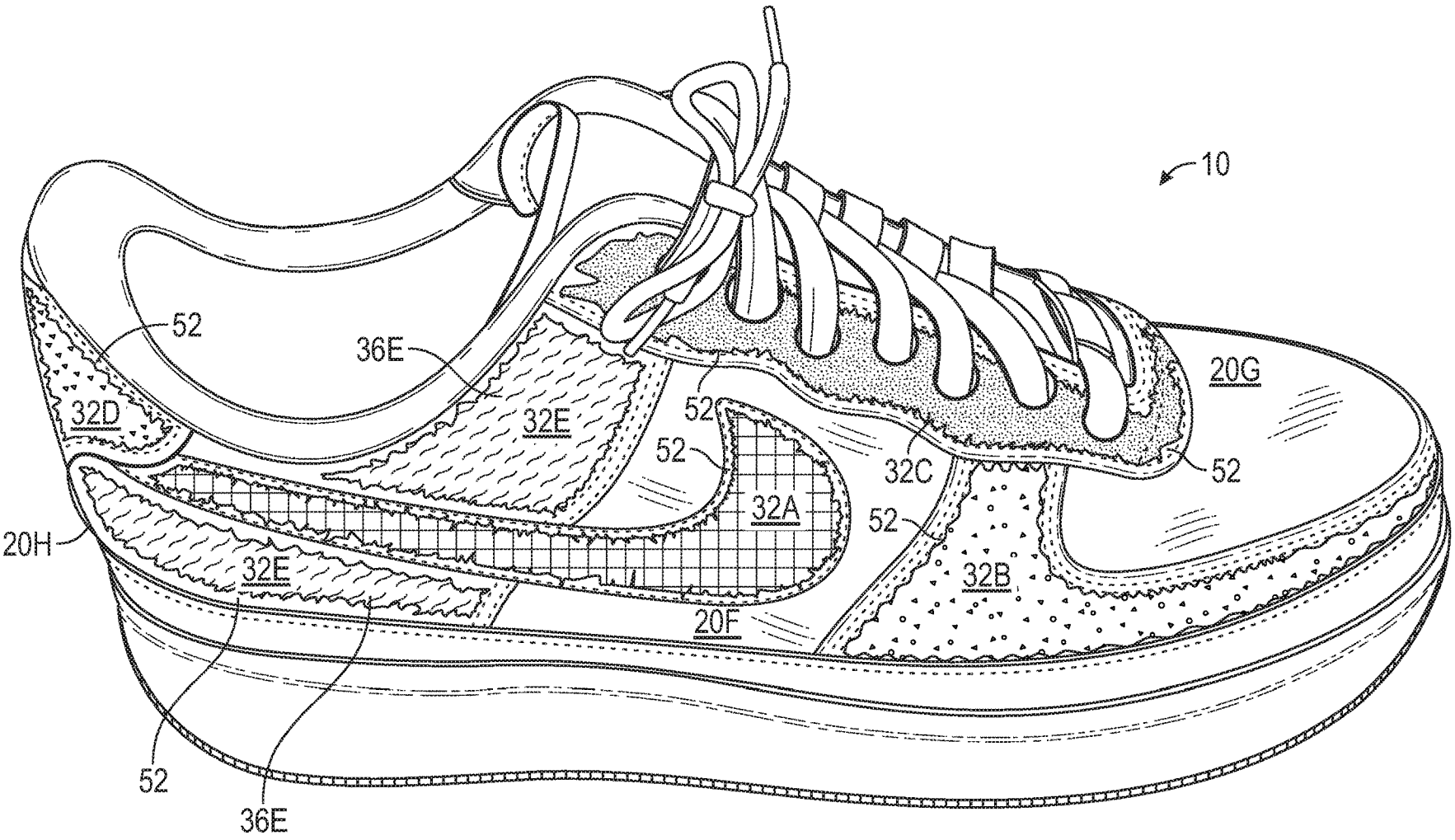
FIG. 9 is a perspective view of the lateral side of the article of footwear of FIG. 1 with five cover layers removed.

FIG. 6 indicates that cover layer 20B has been removed second in order, revealing the outer side 36B of base layer 32B. FIG. 7 indicates that cover layer 20C has been removed third in order, revealing the outer side 36C of base layer 32C. FIG. 8 indicates that cover layer 20D has been removed fourth in order, revealing the outer side 36D of base layer 32D. FIG. 9 indicates that cover layer 20E has been removed fifth in order, revealing the outer side 36E of base layer 32E. Because the base layer 32A overlays the cover layer 20E of the base layer 32E, the portion of the cover layer 20E above the base layer 32A may need to be removed separately from the portion of the cover layer 20E below the base layer 32A. A portion of the cover layer 20E sandwiched between the base layer 32A and the base layer 32E (e.g., over outer side of base layer 32E but under base layer 32A) may or may not remove when the upper and lower portions of the cover layer 20E are removed but is hidden under the base layer 32E in any event.

Figure 10:
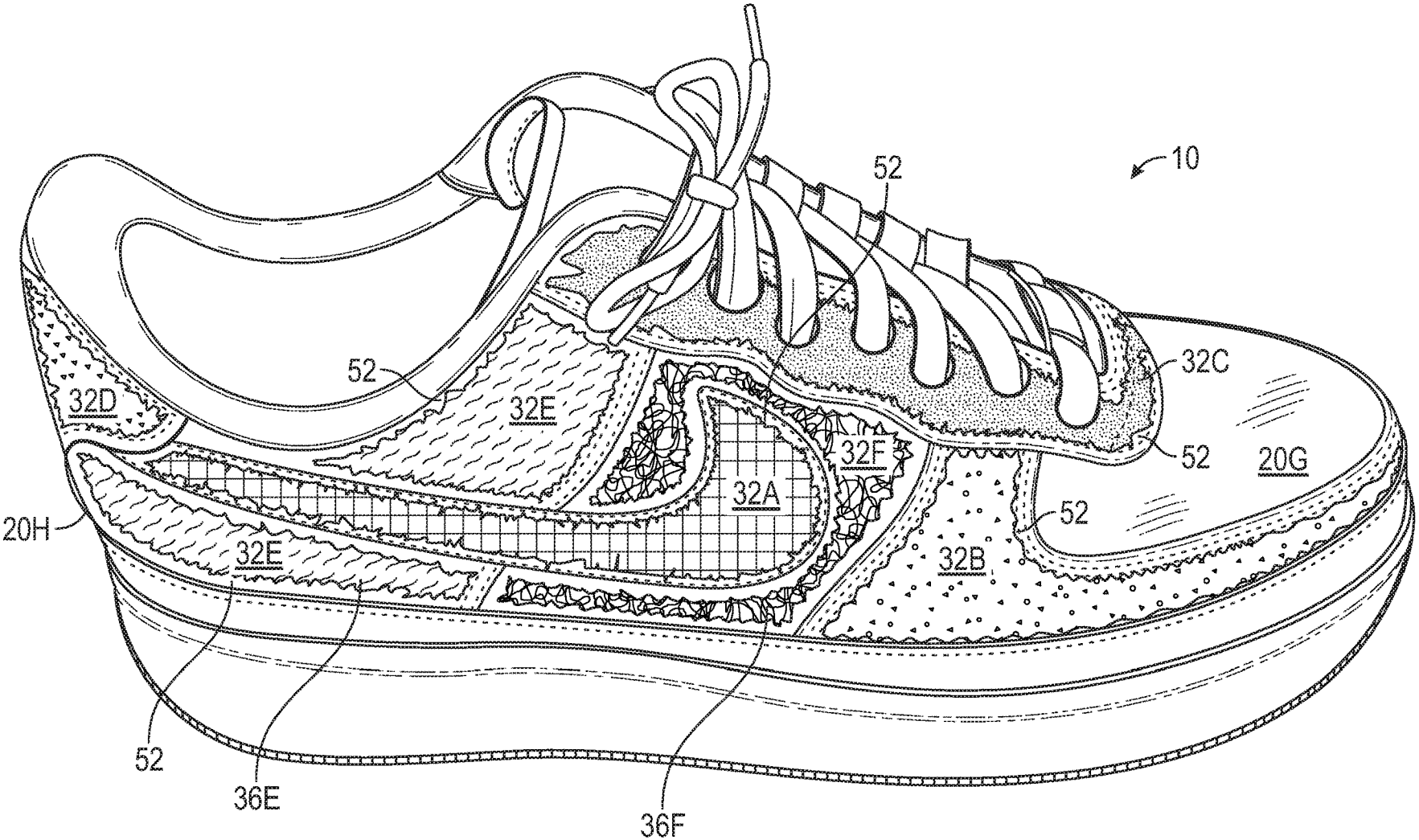
FIG. 10 is a perspective view of the lateral side of the article of footwear of FIG. 1 with six cover layers removed.
Figure 11:
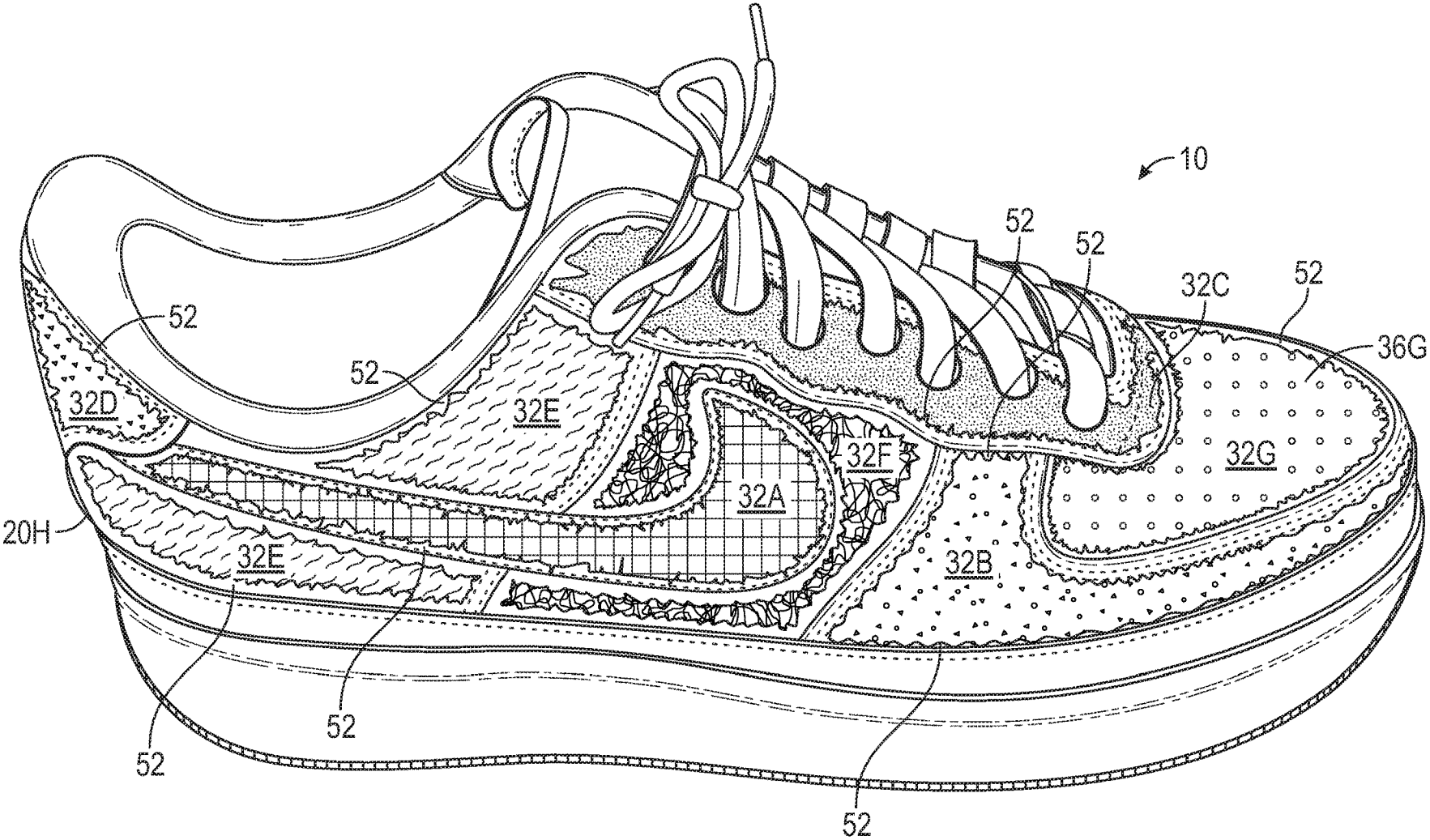
FIG. 11 is a perspective view of the lateral side of the article of footwear of FIG. 1 with seven cover layers removed.
Figure 12:
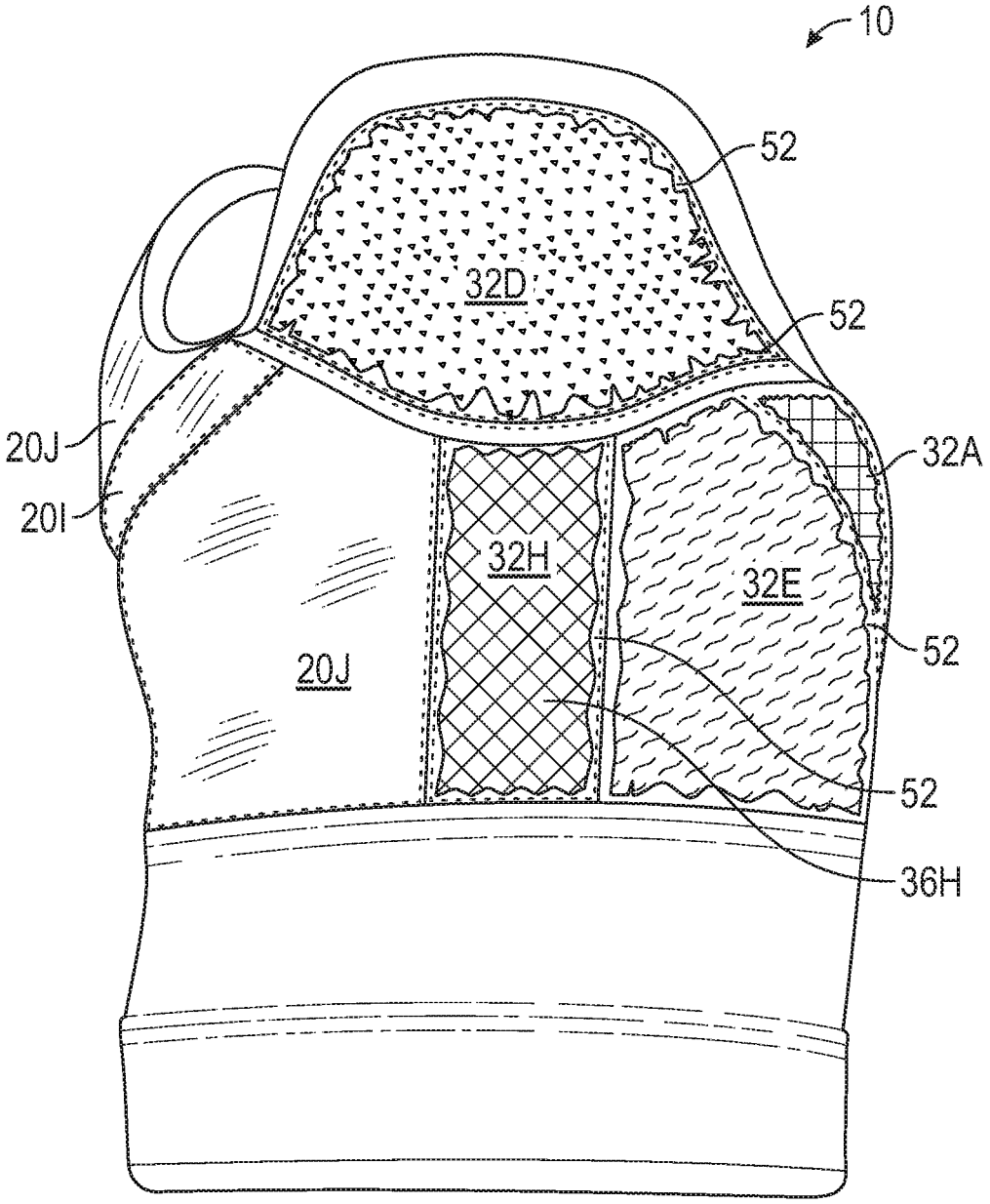
FIG. 12 is a rear view of the article of footwear of FIG. 1 with at least four cover layers removed.
Figure 13:
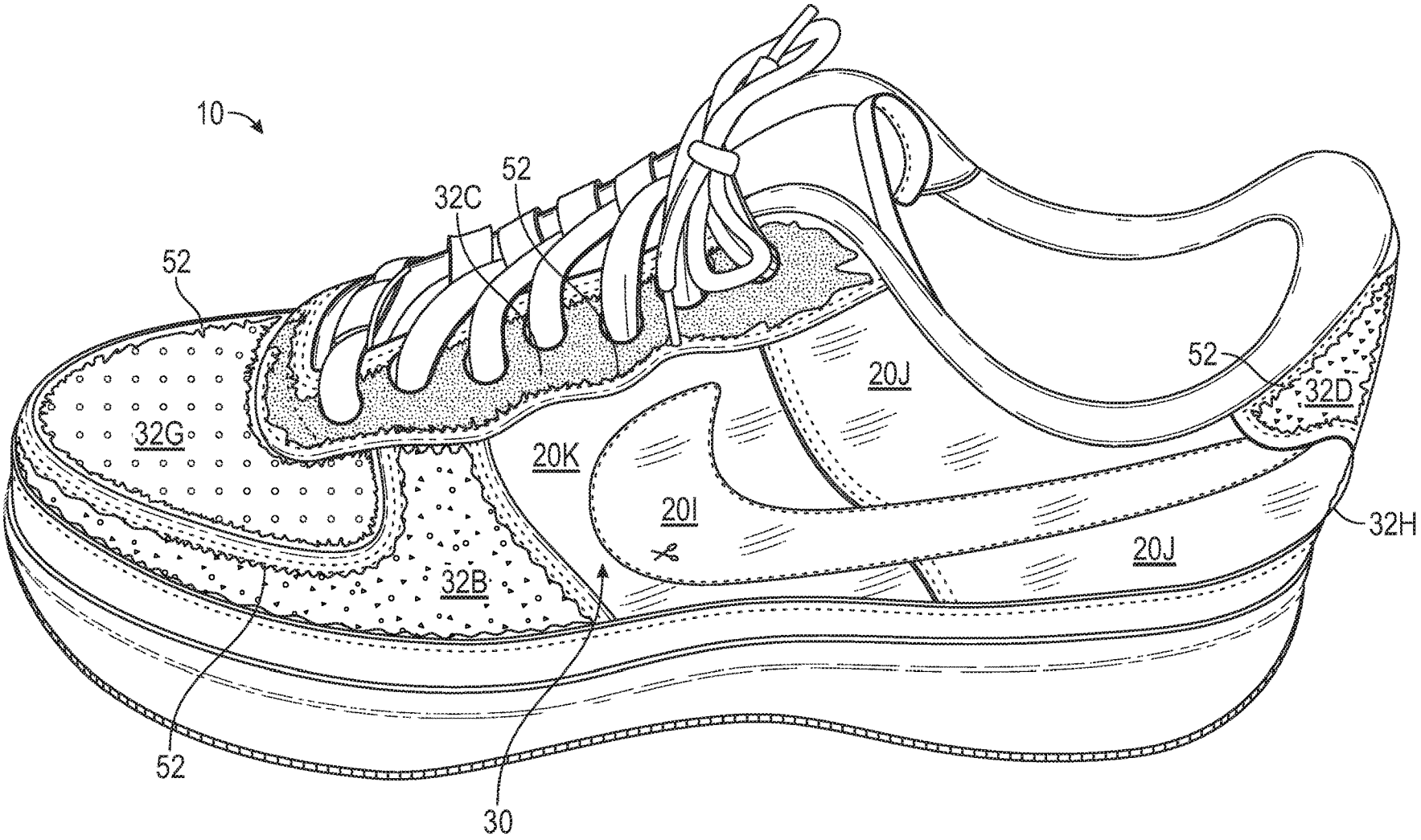
FIG. 13 is a perspective view of the medial side of the article of footwear of FIG. 1 showing four cover layers removed.
Figure 14:
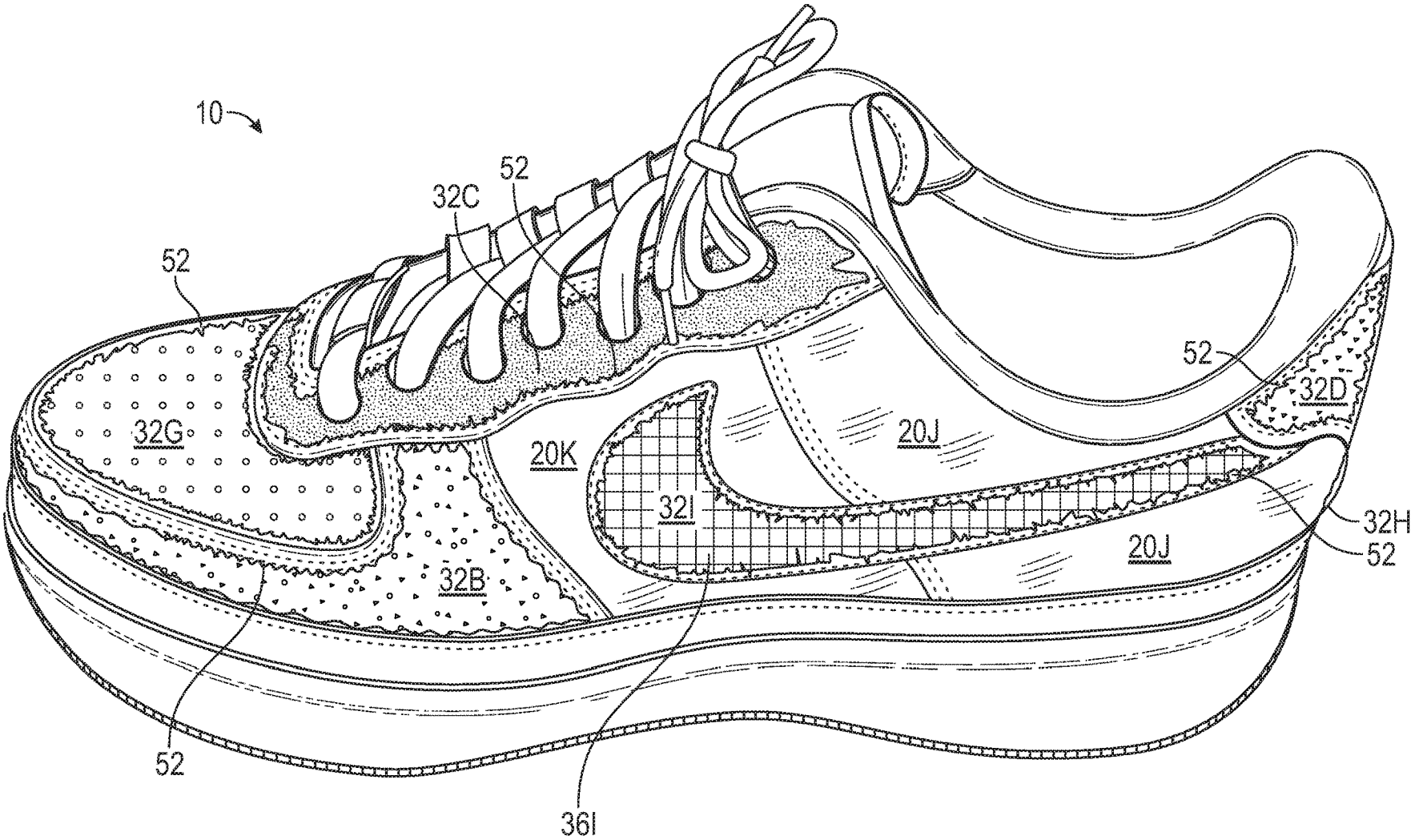
FIG. 14 is a perspective view of the medial side of the article of footwear of FIG. 1 showing five cover layers removed.
Figure 15:
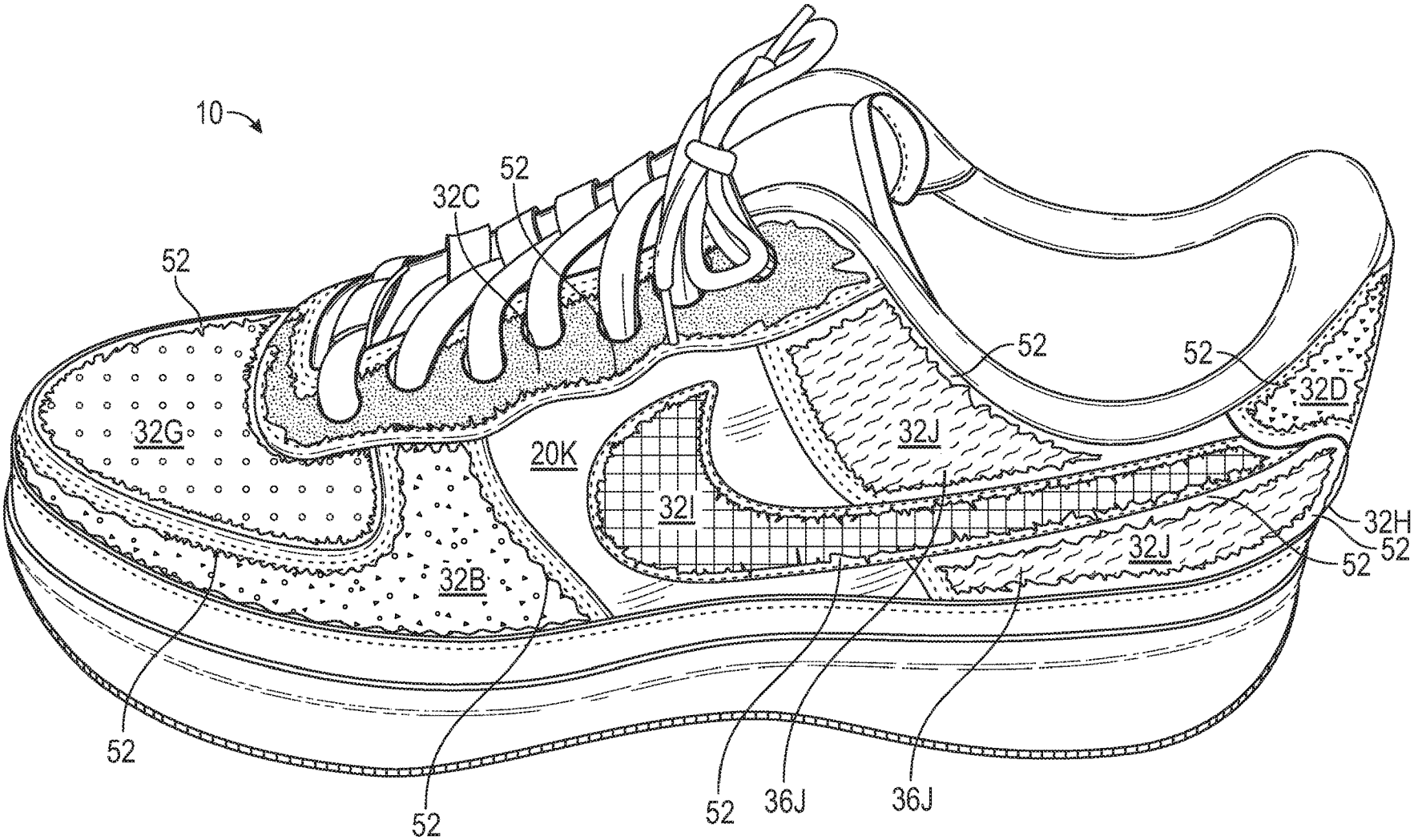
FIG. 15 is a perspective view of the medial side of the article of footwear of FIG. 1 showing six cover layers removed.
Figure 16:
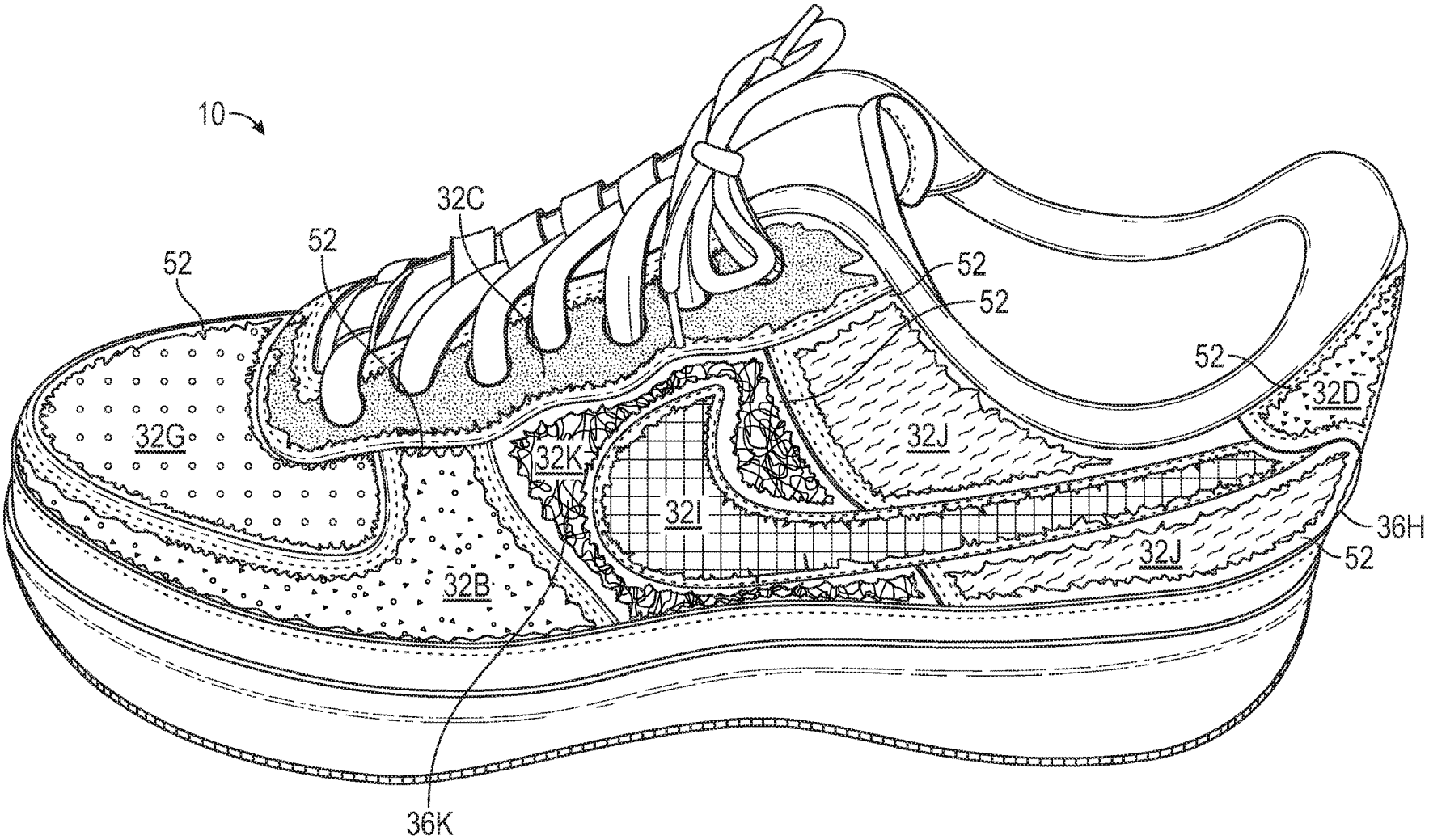
FIG. 16 is a perspective view of the medial side of the article of footwear of FIG. 1 showing seven cover layers removed.

FIG. 10 indicates that cover layer 20F has been removed sixth in order, revealing the outer side 36F of base layer 32F. FIG. 11 indicates that cover layer 20G has been removed seventh in order, revealing the outer side 36G of base layer 32G. FIG. 12 indicates that cover layer 20H has been removed eighth in order, revealing the outer side 36H of base layer 32H. FIG. 13 shows the medial side 30 of the article of footwear 10 without any additional cover layers removed than are removed in FIG. 12. FIG. 14 indicates that cover layer 20I has been removed ninth in order, revealing the outer side 36I of base layer 32I. FIG. 15 indicates that cover layer 20J has been removed tenth in order, revealing the outer side 36J of base layer 32J. Because the base layer 32I overlays the cover layer 20J of the base layer 32J, the portion of the cover layer 20J above the base layer 32I may need to be removed separately from the portion of the cover layer 20J below the base layer 32I. A portion of the cover layer 20J sandwiched between the base layer 32I and the base layer 32J (e.g., over outer ide of base layer 32J but under base layer 32I) may or may not remove when the upper and lower portions of the cover layer 20J are removed but is hidden under the base layer 32I in any event. FIG. 16 indicates that cover layer 20K has been removed eleventh in order, revealing the outer side 36K of base layer 32K. Accordingly, in FIG. 16, all cover layers 20A-20K have been removed.

Some or all of base layers 32A-32K may have different aesthetic or functional aspects. In the embodiment of the article of footwear 10, many of the base layers 32A-32K have a different appearance due to different colors, materials, patterns, or textures such as of their respective outer sides. The following description of the colors, materials, patterns, and textures of the base layers 32A-32K is one nonlimiting example. In the example of the article of footwear 10 shown, base layers 32F and 32K are a felted material, base layer 32C is suede, base layer 32E is a pebbled leather material, and any or all of the remaining base layers 32A-32B, 32D, 32G-32J may be a natural or artificial leather of any type including pebbled or patent leather or suede, a vinyl material, a woven or nonwoven material with thermoplastic polyurethane threads, for example, a felt, a denim, or another type of material. Base layers 32A, 32H, and 32J have a decorative cross-hatch pattern. Base layer 32B has a pattern of stars. Base layer 32C is a solid color. Base layer 32D is a speckled pattern. Base layers 32E and 32J have a pebbled texture. Base layers 32F and 32K are solid colors. Base layer 32G is a perforated material of a solid color.

Some of the materials may be selected to provide a specific function in addition to the general function of forming a discrete section of a durable upper 14. For example, the perforated material of base layer 32G has the function of increasing ventilation of the footwear 10. The suede of base layer 32C has a relatively high coefficient of friction and may decrease slip of the lace 18 in comparison to a material of a lesser coefficient of friction. The pebbled leather of the base layers 32E and 32J as well as the felted material of the base layers 32F and 32K may be relatively flexible in comparison to a stiffer material and may enable better conformance of the base layers 32E, 32F, 32J, and 32K to the shape of the foot when the lace 18 tightens the upper 14. Any or all of the base layers 32A-32K may have different colors or the same color. Accordingly, at least some of the base layers 32A-32K are different in appearance or function.

Figure 17:
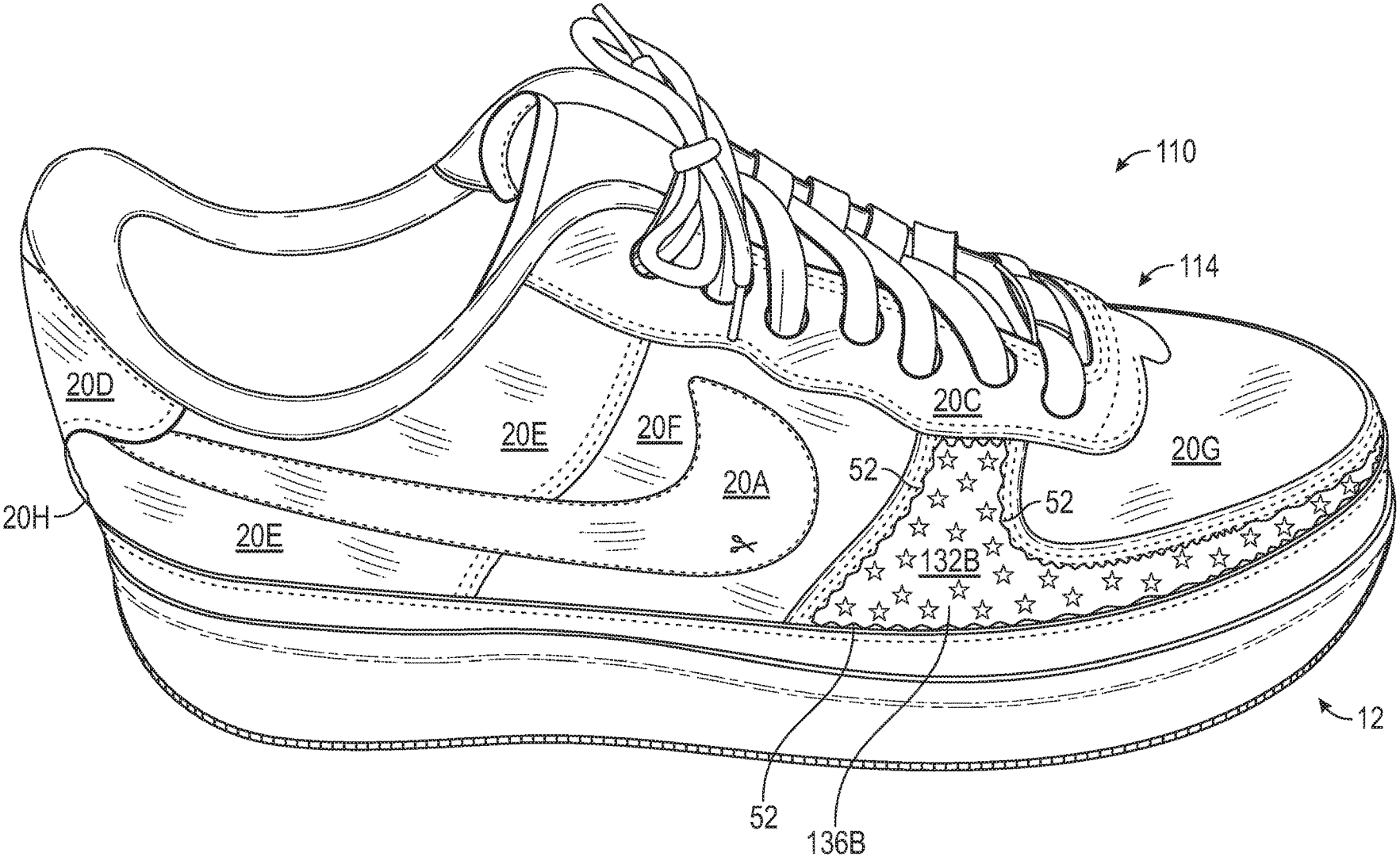
FIG. 17 is a perspective view of a lateral side of an alternative article of footwear with a cover layer removed.

FIG. 17 shows a second article of footwear 110 with a second upper 114 alike in all aspects to the first upper 14 of the first article of footwear 10 except that the base layer 132B that underlies the cover layer 20B (removed in FIG. 17) has a different material than base layer 32B of the footwear 10. For example, base layer 32B of the first article of footwear 10 may be white leather with stars as shown and base layer 132B of the second article of footwear 110 may be black patent leather at its outer side 136B. Accordingly, the configuration of the footwear 10, 110 enables two articles of footwear 10, 110 that each have cover layers 20A-20K and corresponding base layers as described to be manufactured with at least one of the base layers of one of the articles of footwear having a different material or color, texture, or pattern than the corresponding base layer of the other article of footwear (e.g., than the base layer disposed in the same relative location on the other article of footwear). The two articles of footwear 10, 110 will have the same appearance when all of the cover layers 20A-20K are intact but different appearances when the corresponding base layers (e.g., 32B, 132B) having the different material or color, texture, or pattern are uncovered. This differentiation may be applied to a pair of footwear (e.g., between a right foot article of footwear and a left foot article of footwear) and/or between different pairs of footwear. Because there are so many permutations of appearances that are possible by varying the material, color, texture, and/or pattern of one or more of the base layers during manufacture of the footwear, each pair of footwear may be made even more unique in appearance.

Figure 18:
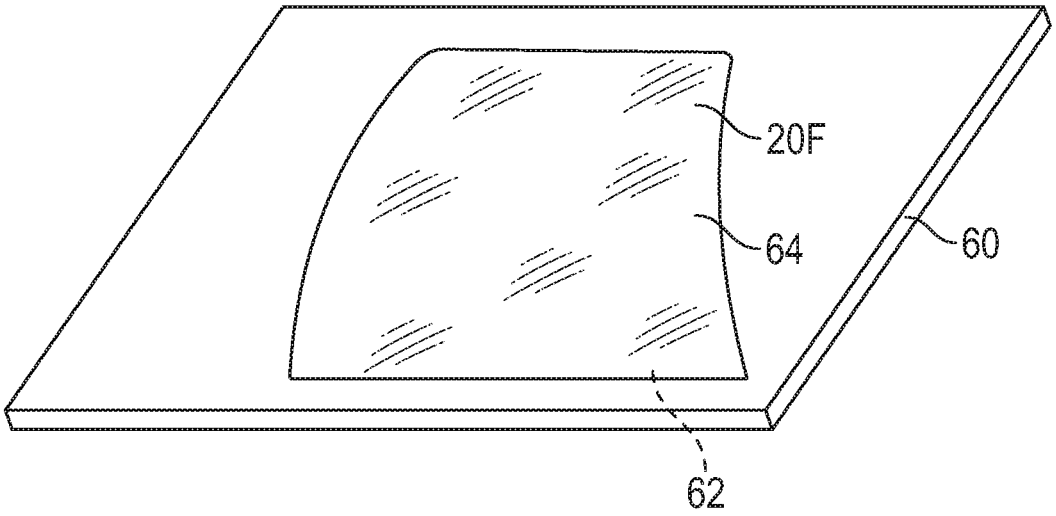
FIG. 18 is a perspective view of one of the cover layers of FIG. 1 disposed on a work table.
Figure 19:
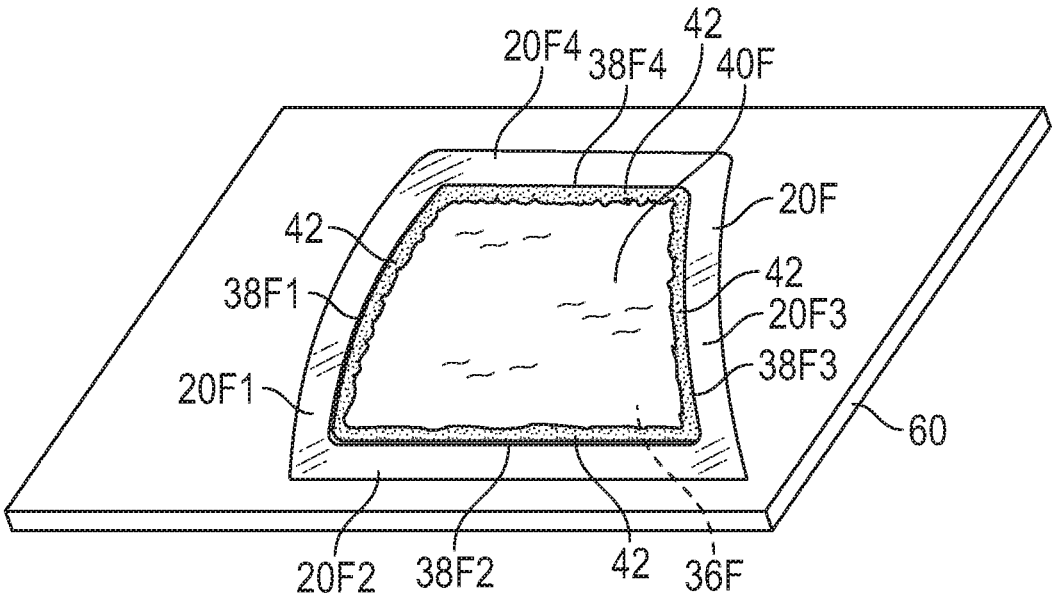
FIG. 19 is a perspective view of the cover layer and work table of FIG. 18 with a base layer of FIG. 1 disposed on the cover layer.
Figure 20:
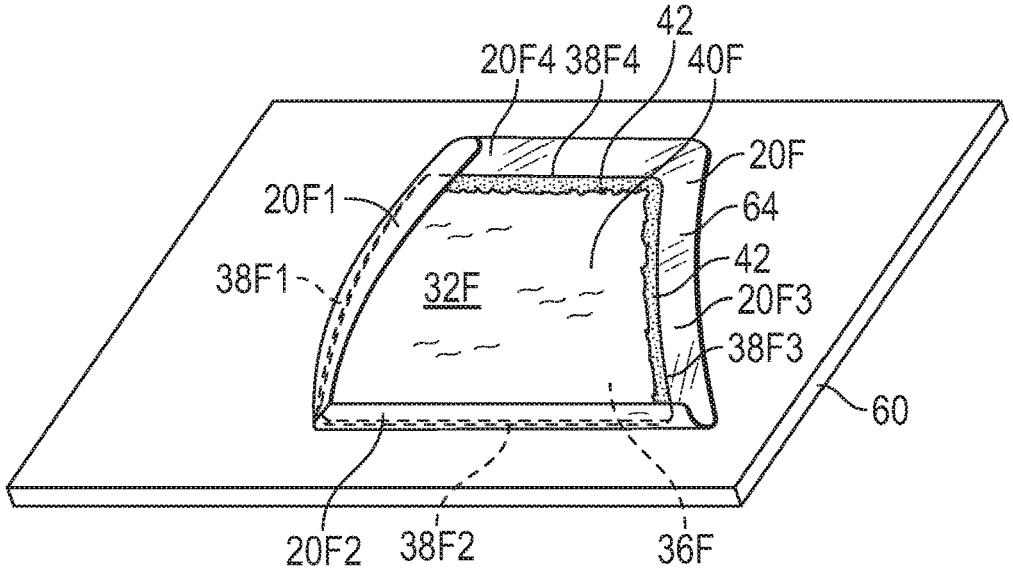
FIG. 20 is a perspective view of the cover layer and work table of FIG. 19 with portions of the cover layer wrapped over peripheral edges of the base layer and adhered to the inner side of the base layer.

FIGS. 18-20 show one example of how a cover layer and its corresponding base layer is assembled prior to stitching together to another base layer and its cover layer as in FIG. 3. Although described with respect to cover layer 20F and base layer 32F, the same process is used to join each cover layer 20A-20K to its corresponding respective base layer 32A-32K. In FIG. 18, the cover layer 20F is shown placed on a work table 60 with its outer side 62 laying against the work table 60 and its inner side 64 facing upward. In FIG. 19, the corresponding base layer 32F is shown placed on the inner side 64 of the cover layer 20F with its outer side 36F against the cover layer 20F and its inner side 40F facing upward. It is apparent in FIG. 19 that the cover layer 20F and the base layer 32F correspond in shape and dimension. As used herein, a cover layer and a base layer correspond in shape and dimension when the cover layer can be wrapped around the peripheral edges of the base layer and then be adhered to the inner side of the base layer, covering all peripheral edges and all of the outer side of the base layer, with the portions wrapped around to the inner side hidden under the base layer. For example, the cover layer 20F is wider and longer than the base layer 32F, leaving portions 20F1, 20F2, 20F3, and 20F4 of the cover layer 20F along each respective peripheral edge 38F1, 38F2, 38F3, and 38F4 of the base layer 32F. The portions 20F1, 20F2, 20F3, and 20F4 can be wrapped around the respective peripheral edges and then can be adhered to the inner side 40F of the base layer 32F. Adhesive 42 is placed on the inner side 40F of the base layer 32F bordering the peripheral edges 38F1, 38F2, 38F3, and 38F4 in preparation for adherence to the cover layer 20F. FIG. 20 shows the process of wrapping the portions 20F1-20F4 of the cover layer 20F around the peripheral edges and securing the portions 20F1-20F4 to the inner side 40F of the base layer 32F. In FIG. 20, two of the portions 20F1 and 20F2 have been wrapped around the peripheral edges 38F1 and 38F2, respectively, and secured with the adhesive 42, while two of the portions 20F3 and 20F4 not yet been wrapped around the respective peripheral edges 38F3 and 38F4. Once each of the base layers and corresponding cover layers have been secured to one another in this manner, adjacent ones of the base layers can be secured to one another with the stitching, as shown and described in detail with respect to base layers 32E, 32F in FIG. 3.

Figure 21:
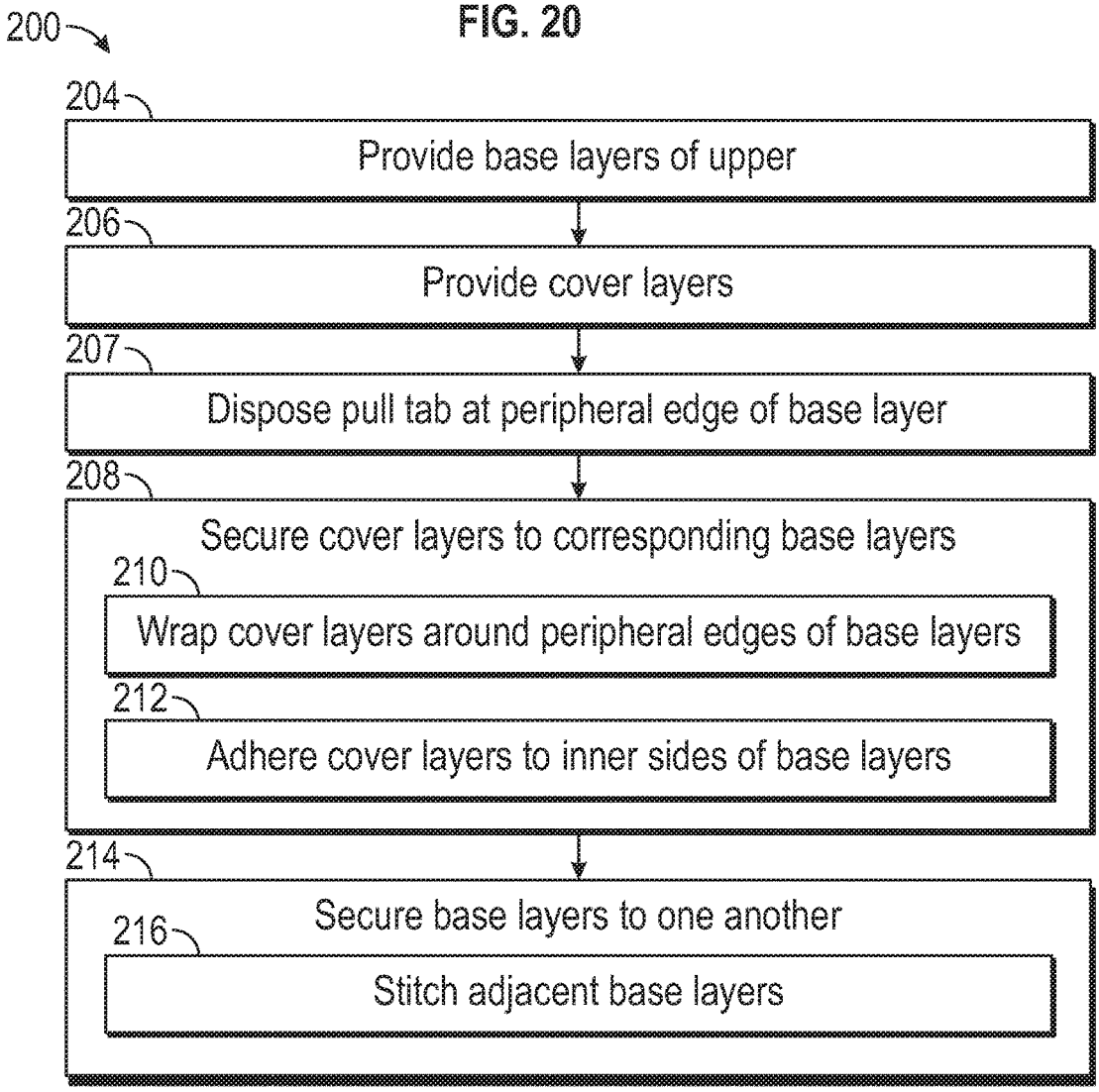
FIG. 21 is a flow diagram of a method of manufacturing the article of footwear of FIG. 1.

FIG. 21 is a flowchart of a method of manufacturing 200 an article of footwear such as the article of footwear 10 or 110 disclosed herein. The method 200 may start at step 204, providing a plurality of base layers 32A-32K of an upper 14, and step 206, providing a plurality of cover layers 20A-20K. Each of the cover layers 20A-20K corresponds in shape and dimension to a respective one of the base layers 32A-32K and together with the base layer forms a discrete section of the upper 14. The base layers 32A-32F and the cover layers 20A-20K may be provided already cut or otherwise formed to their final shapes and dimensions or may be cut or otherwise formed to their final shapes and dimensions as part of the method steps 204, 206, respectively.

If any of the cover layers 20A-20K include a pull tab such as pull tab 48 of FIG. 4, the method 200 may include in step 207, prior to securing the cover layers 20A-20K to the base layers 32A-32K, disposing the pull tab 48 at a peripheral edge of the corresponding base layer to which the cover layer is to be secured. For example, as discussed with respect to FIG. 4, the pull tab 48 is disposed at the peripheral edge 50 of base layer 32C.

Next, in step 208, the method 200 may include securing the cover layers 20A-20K to the corresponding base layers 32A-32K with each cover layer secured to a different corresponding one of the base layers so that the cover layer covers an outer side of the base layer. For example, as shown in FIGS. 3 and 20, the cover layer 20F covers the outer side 36F of the base layer 32F.

Next, the method 200 moves to step 208, securing the cover layers 20A-20K to the respective base layers 32A-32K. Step 208 may include substep 210, wrapping the cover layers 20A-20K around peripheral edges of the base layers 32A-32K as discussed with respect to portions 20F1-20F4 of cover layer 20F wrapping around the peripheral edges 38F1-38F4 of base layer 32F in FIGS. 3 and 20.

Step 208, securing the cover layers 20A-20K to the base layers 32A-32K, may also include substep 212, securing the cover layers 20A-20K to inner sides of the base layers 32A-32K. For example, securing the cover layers 20A-20K to inner sides of the base layers 32A-32K in substep 212 may include adhering the cover layers 20A-20K to the inner sides of the base layers 32A-32K with adhesive 42 as discussed with respect to FIGS. 3 and 20.

After securing the cover layers 20A-20K to the base layers 32A-32K in step 208, the method 200 may move to step 214, securing the base layers 32A-32K to one another to define a foot-receiving cavity 16 with each cover layer 20A-20K selectively removable from the different corresponding one of the base layers 32A-32K independently of each other cover layer to expose the outer side 36A-36K of the base layers 32A-32K while each other cover layer remains secured to and covering the outer side of a different corresponding base layer until independently selectively removed.

Step 214, securing the base layers 32A-32K to one another, may include substep 216, stitching adjacent ones of the base layers 32A-32K to one another with a series of stitches 34, the series of stitches extending through the adjacent ones of the base layers 32A-32K and through the cover layers 20A-20K secured to the adjacent ones of the base layers 32A-32K. Substep 216 is illustrated in FIG. 3 with respect to the stitches 34 extending through the adjacent base layers 32E and 32F and their corresponding cover layers 20E and 20F, respectively.

After sub step 216, the method 200 may end with respect to the article of footwear 10. Because the method 200 enables different articles of footwear manufactured in the same manner to have the same initial look (e.g., when the base layers are covered by the cover layers) but different appearances once one or more of the base layers are revealed, the method 200 may be repeated to manufacture a second article of footwear such as footwear 110. For example, after step 208, the method 200 may again move to step 204, which may include providing a second plurality of base layers 32A, 32C-32K and 132B of a second upper 114, the second plurality of base layers 32A, 32C-32K and 132B corresponding in shape and dimension to the plurality of base layers 32A-32K of the first upper 14 of the first article of footwear 10 but at least one of the second plurality of base layers 132B comprising a different material or having a different color, texture, or pattern than a corresponding one the base layers 32B of the first article of footwear 10. The method 200 may repeat step 206, this time providing a second plurality of cover layers 20A-20K. Step 207 may be repeated if any of the cover layers of the second plurality have a pull tab 48. Step 208 may be repeated, securing the second plurality of cover layers 20A-20K to the second plurality of base layers, including substeps 210 and 212. Next, the method 200 may include step 214, but this time securing the second plurality of base layers 32A, 32C-32K and 132B to one another with each cover layer 20A-20K of the second plurality of cover layers selectively removable from the different corresponding one of the second plurality of base layers independently of each other cover layer of the second plurality of cover layers to expose the outer side of the base layer with each other cover layer of the second plurality of cover layers remaining secured to and covering the corresponding one of the base layers until independently selectively removed. Because at least one of the second plurality of base layers 132B may comprise a different material or may have a different color, texture, or pattern than a corresponding one the base layers 32B of the first article of footwear 10, the second article of footwear 110 will have a different appearance than the first article of footwear when the cover layer of that base layer is removed. More specifically, the second upper 114 will have a different appearance.

The footwear 10, 110 and the method 200 disclosed herein enable a unique customer experience that includes the ability to change the appearance of a pair of footwear during its use one or more times (e.g., by removing one or more different ones of the cover layers). Additionally, if the footwear is purchased without an identification of the materials, patterns, and/or colors of the underlying base layers, the selective revealing of the base layers adds an element of surprise.

The following Clauses provide example configurations of an article of footwear and a method of manufacturing and article of footwear disclosed herein.

Clause 1. An article of footwear comprising: an upper having a plurality of discrete sections secured to one another and each of the discrete sections including a base layer and a cover layer; and wherein each cover layer is secured to and covers an outer side of a corresponding base layer and is configured to be selectively removable independently of each other cover layer to expose the outer side of the base layer.

Clause 2. The article of footwear of clause 1, wherein each base layer has a peripheral edge and the cover layer secured to the base layer has a portion wrapped around and covering the peripheral edge.

Clause 3. The article of footwear of clause 2, wherein the cover layer includes a portion wrapped over the peripheral edge and adhered to an inner side of the base layer.

Clause 4. The article of footwear of any of clauses 1-3, wherein each cover layer is secured to the corresponding base layer by stitches extending through the cover layer and the corresponding base layer.

Clause 5. The article of footwear of any of clauses 1-4, wherein each cover layer is opaque.

Clause 6. The article of footwear of any of clauses 1-5, wherein each base layer is bordered by two other base layers.

Clause 7. The article of footwear of any of clauses 1-6, wherein at least one cover layer defines an integral pull tab disposed at an edge of the corresponding base layer when the cover layer is secured to the corresponding base layer.

Clause 8. The article of footwear of clause 7, wherein the at least one cover layer defining the integral pull tab is disposed on a throat portion of the upper with the integral pull tab extending forward over a toe region of the upper.

Clause 9. The article of footwear of any of clauses 1-8, wherein at least one cover layer comprises a nonwoven textile.

Clause 10. The article of footwear of any of clauses 1-9, wherein the cover layers are configured to be independently selectively removable in any combination.

Clause 11. The article of footwear of any of clauses 1-10, wherein the cover layers are configured to be independently selectively removable in any order.

Clause 12. The article of footwear of any of clauses 1-11, wherein the outer side of at least one of the base layers comprises a different material or has a different color, texture, or pattern than at least one other of the base layers.

Clause 13. The article of footwear of any of clauses 1-12, wherein at least one cover layer is entirely on a lateral side of the upper.

Clause 14. The article of footwear of any of clauses 1-13, wherein at least one cover layer is entirely on a medial side of the upper.

Clause 15. A method of manufacturing an article of footwear, the method comprising: providing a plurality of base layers of an upper; providing a plurality of cover layers; securing the cover layers to the base layers, each cover layer secured to a corresponding one of the base layers so that the cover layer covers an outer side of the base layer; after securing the cover layers to the base layers, securing the base layers to one another to define a foot-receiving cavity with each cover layer selectively removable from the corresponding one of the base layers independently of each other cover layer to expose the outer side of the corresponding one of the base layers with each other cover layer remaining secured until independently selectively removed.

Clause 16. The method of clause 15, wherein securing the cover layers to the corresponding one of the base layers includes wrapping the cover layers around peripheral edges of the base layers and securing the cover layers to inner sides of the base layers.

Clause 17. The method of clause 16, wherein securing the cover layers to inner sides of the base layers includes adhering the cover layers to the inner sides of the base layers.

Clause 18. The method of any of clauses 15-17, wherein securing the base layers to one another includes stitching adjacent ones of the base layers to one another with a series of stitches, the series of stitches extending through the adjacent ones of the base layers and through the cover layers secured to the adjacent ones of the base layers.

Clause 19. The method of any of clauses 15-18, wherein: at least one of the cover layers includes a pull tab; and prior to securing the cover layers to the base layers, disposing the pull tab at a peripheral edge of the base layer to which the at least one of the cover layers is to be secured.

Clause 20. The method of any of clauses 15-18, wherein the base layers and the cover layers are of a first article of footwear, the method further comprising manufacturing a second article of footwear by: providing a second plurality of base layers of a second upper; wherein the second base layers correspond in shape and dimension to the plurality of base layers of the first article of footwear with at least one of the second plurality of base layers comprising a different material or having a different color, texture, or pattern than a corresponding one the base layers of the first article of footwear; providing a second plurality of cover layers; securing the second plurality of cover layers to the second plurality of base layers, each cover layer of the second plurality of cover layers secured to and covering an outer side of a corresponding one of the base layers of the second plurality of base layers; after securing the second plurality of cover layers to the second plurality of base layers, securing the second plurality of base layers to one another with each cover layer of the second plurality of cover layers selectively removable from the corresponding one of the second plurality of base layers independently of each other cover layer of the second plurality of base layers to expose the outer side of the base layer with each other cover layer of the second plurality of cover layers remaining secured until independently selectively removed.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about"

is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

an upper having a plurality of discrete sections secured to one another, each of the discrete sections including a cover layer and a corresponding base layer, the cover layer secured to and covering an outer side of the corresponding base layer and selectively removable independently of each other cover layer to expose the outer side of the corresponding base layer without exposing the outer side of any other corresponding base layer of any other discrete section; and wherein directly adjacent ones of the base layers are secured to one another with stitching that extends through the directly adjacent ones of the base layers.

2. The article of footwear of claim 1, wherein each base layer has a peripheral edge and the cover layer secured to the corresponding base layer has a portion wrapped around and covering the peripheral edge.

3. The article of footwear of claim 2, wherein the cover layer secured to the corresponding base layer includes another portion wrapped over the peripheral edge and adhered to an inner side of the base layer.

4. The article of footwear of claim 1, wherein each cover layer is secured to the corresponding base layer by stitches extending through the cover layer and the corresponding base layer.

5. The article of footwear of claim 1, wherein each cover layer is opaque.

6. The article of footwear of claim 1, wherein the plurality of discrete sections includes at least three discrete sections, and each base layer is bordered by two other base layers.

7. The article of footwear of claim 1, wherein the cover layer of at least one of the discrete sections defines an integral pull tab disposed at an edge of the corresponding base layer to which the cover layer is secured.

8. The article of footwear of claim 7, wherein the cover layer defining the integral pull tab is disposed on a throat portion of the upper with the integral pull tab extending forward over a toe region of the upper.

9. The article of footwear of claim 1, wherein the cover layer of at least one of the discrete sections comprises a nonwoven textile.

10. The article of footwear of claim 1, wherein the cover layers are configured to be selectively removable in any combination.

11. The article of footwear of claim 1, wherein the cover layers are configured to be selectively removable in any order.

12. The article of footwear of claim 1, wherein the base layer of at least one of the discrete sections comprises a different material or has a different color, texture, or pattern than the base layer of at least one other of the discrete sections.

13. The article of footwear of claim 1, wherein the cover layer of at least one of the discrete sections is entirely on a lateral side of the upper.

14. The article of footwear of claim 1, wherein the cover layer of at least one of the discrete sections is entirely on a medial side of the upper.

15. The article of footwear of claim 1, wherein the stitching further extends through the cover layers covering the adjacent base layers.

16. The article of footwear of claim 1, wherein the adjacent base layers at least partially overlap one another at the stitching.

17. An article of footwear comprising:

an upper having a plurality of discrete sections secured to one another, each of the discrete sections including a cover layer and a corresponding base layer, the cover layer secured to and covering an outer side of the corresponding base layer and selectively removable independently of each other cover layer to expose the outer side of the corresponding base layer without exposing the outer side of any other corresponding base layer of any other discrete section; and wherein each base layer has a peripheral edge and the cover layer secured to the corresponding base layer has a portion wrapped around and covering the peripheral edge.

18. The article of footwear of claim 17, wherein the cover layer secured to the corresponding base layer includes another portion wrapped over the peripheral edge and adhered to an inner side of the base layer.

19. An article of footwear comprising:

an upper having a plurality of discrete sections secured to one another, each of the discrete sections including a cover layer and a corresponding base layer, the cover layer secured to and covering an outer side of the corresponding base layer and selectively removable independently of each other cover layer to expose the outer side of the corresponding base layer without exposing the outer side of any other corresponding base layer of any other discrete section;

wherein the cover layer of at least one of the discrete sections defines an integral pull tab disposed at an edge of the corresponding base layer to which the cover layer is secured; and wherein the cover layer defining the integral pull tab is disposed on a throat portion of the upper with the integral pull tab extending forward over a toe region of the upper.

* * * * *